US011014788B1

(12) United States Patent
Gentile

(10) Patent No.: US 11,014,788 B1
(45) Date of Patent: May 25, 2021

(54) MODULAR CRANE ATTACHMENT DEVICE FOR PURLINS

(71) Applicant: Jacob Gentile, Loma Rica, CA (US)

(72) Inventor: Jacob Gentile, Loma Rica, CA (US)

( * ) Notice: Subject to any disclaimer, the term of this patent is extended or adjusted under 35 U.S.C. 154(b) by 33 days.

(21) Appl. No.: 16/709,037

(22) Filed: Dec. 10, 2019

(51) Int. Cl.
*B66C 1/34* (2006.01)
*B66C 1/64* (2006.01)

(52) U.S. Cl.
CPC . *B66C 1/34* (2013.01); *B66C 1/64* (2013.01)

(58) Field of Classification Search
CPC .... B66C 1/22; B66C 1/34; B66C 1/62; B66C 1/64; E04D 15/07
See application file for complete search history.

(56) References Cited

U.S. PATENT DOCUMENTS 2,965,408 A * 12/1960 Edwards ..... B66C 1/64 294/81.5
4,397,492 A * 8/1983 Craig ..... B66C 1/12 294/81.1
5,476,300 A * 12/1995 Dodge ..... B66C 1/54 294/67.33
6,053,550 A * 4/2000 Paterson ..... B66C 1/22 294/81.51
6,957,838 B2 * 10/2005 Nowak ..... B66C 1/10 294/67.1
2001/0055523 A1 * 12/2001 Slodden ..... B66C 1/48 414/458

* cited by examiner

*Primary Examiner* — Dean J Kramer
(74) *Attorney, Agent, or Firm* — Craig A. Simmermon

(57) ABSTRACT

Modular crane attachment device for purlins is a crane attachment jig that attaches to the hook of a crane and functions to lift a plurality of purlins in one lift to place each purlin at the precise location on the rafters of a building under construction to allow for immediate attachment of all purlins to the rafters wherein each purlin is fastened into place while held by the crane and modular crane attachment device for purlins, which functions as a giant assembly jig in this manner. Modular crane attachment device for purlins is modular so that it can be broken down by hand into a bundle of 10-20 foot long structural members, fittings, and cables. Modular crane attachment device for purlins is modular so it can be assembled in any length and width to fit any application of any number and any length of purlins required for the building.

6 Claims, 16 Drawing Sheets

MODULAR CRANE ATTACHMENT DEVICE FOR PURLINS

BACKGROUND OF THE INVENTION

1. Field of the Invention

This invention relates to a crane attachment device and specifically to a crane attachment device that lifts a plurality purlins and sets the plurality of purlins onto the rafters of a steel building under construction. Modular crane attachment device for purlins lifts a plurality of purlins in one lift and sets the plurality of purlins in the exact position or close proximity required for immediate attachment to the rafters of a steel building under construction, which minimizes crane time, construction time, manpower, and safety hazards for the construction of a metal building.

2. Description of Related Art

This invention is used for the construction of a metal building and more specifically for the construction of a roof or roof framing on a metal building. A metal building roof or roof frame consists of a series of parallel rafters extending from one side of the building to the opposite side of the building. Attached to the rafters and at right angle to the rafters is a series of parallel purlins. A purlin is a horizontal beam along the length of a roof that is attached to one or more rafters. The roofing barrier or roofing sheet material is then attached on top of the purlins.

This invention is a device that is attached to a crane and set down near the supply stock of purlins on a construction site. Where a plurality of purlins is loaded onto this device that may include enough purlins to complete or fill in the entire width of the building. The device is then used to lift the plurality of purlins up to the rafters of a metal building under construction and, all at once, set each purlin in the exact location required for rigid attachment to the rafters. After all the purlins are attached to the rafters, the device is then set back down near the supply stock of purlins to repeat the cycle over and over again until all purlins are installed and set on the metal building. Prior to this invention, the standard way to attach purlins to the roof of a metal building was to lift and attach purlins on a one by one bases in between completed bays. With this invention, the entire bay may be filled with purlins with one crane lift rather than requiring several dozen crane lifts using the standard method.

There are many crane attachment devices in the prior art, however, there are none with the aspects as shown and described below. Modular crane attachment device for purlins is modular so that modules may be added or removed to yield the exact purlin carrying capacity that is required for any specific building size. Modular crane attachment device for purlins includes a plurality of adjustable J-hooks that are removeably attachable to any location along the length of the crane attachment device. Adjustable J-hooks are adjustable to receive and hold any size purlin. Modular crane attachment device for purlins is adjustable for pitch to accommodate the pitch of any roof of any metal building. Modular crane attachment device for purlins may be disassembled into a bundle of 10-20 foot long lengths of steel tubing that can be loaded onto a small truck or pickup truck. In best mode, modular crane attachment device for purlins may be quickly reassembled on the job site without requiring the use of any tools such as wrenches or screwdrivers.

BRIEF SUMMARY OF THE INVENTION

It is an aspect of modular crane attachment device for purlins to attach to a hook or lift point of a crane.

It is an aspect of modular crane attachment device for purlins function with a crane that lifts heavy objects up and down on a construction site.

It is an aspect of modular crane attachment device for purlins to lift a plurality of purlins and place each purlin at the precise location on the rafters of a building to allow for immediate attachment of all purlins to the rafters wherein each purlin is fastened into place while held by the crane and modular crane attachment device for purlins which functions as an assembly jig in this manner.

It is an aspect of modular crane attachment device for purlins to lift a plurality of cross members and place each cross member at the precise location on the studs or wall of a building to allow for immediate attachment of all cross members to the studs or wall wherein each purlin is fastened into place while held by the crane and modular crane attachment device for purlins which functions as an assembly jig in this manner.

It is an aspect of modular crane attachment device for purlins to be modular where any number of modules may be assembled together to yield any length and any width in order to carry and lift any number and any length of purlins.

It is an aspect of modular crane attachment device for purlins to have a frame that includes a center section, a right section, and a left section.

It is an aspect of modular crane attachment device for purlins to include a hoist post that is pivotally attached to the frame of modular crane attachment device for purlins.

It is an aspect of modular crane attachment device for purlins to include a plurality of J-hooks that can be adjustably reversibly attachable to any position along the length of modular crane attachment device for purlins.

It is an aspect of modular crane attachment device for purlins to be modular so that the entire assembly may be broken down and dissembled into a bundle of 10-20 foot long structural members, fittings, and cables that can fit in any small truck or pickup truck.

It is an aspect of modular crane attachment device for purlins to be modular so that the entire assembly may be assembled from a bundle of 10-20 foot long structural members, fittings, and cables.

It is an aspect of best mode modular crane attachment device for purlins to be fully assembled from a bundle of 10-20 foot long structural members, fittings, and cables by hand and without any tools.

DEFINITION LIST

| Term | Definition |
|---|---|
| 5 | Modular Crane Attachment Device for Purlins |
| 10 | Hoist Post |
| 11 | Hoist Post Cap |
| 12 | Hoist Post Cap Lift Hole |
| 13 | Left Lobe |
| 14 | Left Lobe Hole |
| 15 | Right Lobe |
| 16 | Right Lobe Hole |
| 17 | Hoist Post Receiver |
| 18 | Upper Hub Plate |
| 19 | Lower Hub Plate |
| 20 | Center Section |
| 21 | Center Section Front Cross Member |
| 22 | Center Section Left Cross Member |
| 23 | Center Section Rear Cross Member |
| 24 | Center Section Right Cross Member |
| 25 | Center Section Front Spreader Bar |
| 26 | Center Section Rear Spreader Bar |
| 27 | Center Section Left End Member |
| 28 | Center Section Right End Member |
| 32 | T-Splice Fitting |
| 34 | Corner Splice Fitting |
| 36 | Pin |
| 40 | Right Section |
| 42 | Right Section Front Spreader |
| 44 | Right Section Rear Spreader |
| 46 | Right Section End Member |
| 48 | Additional Right Section |
| 50 | Left Section |
| 52 | Left Section Front Spreader |
| 54 | Left Section Rear Spreader |
| 56 | Left Section End Member |
| 58 | Additional Left Section |

-continued

DEFINITION LIST

| Term | Definition |
|---|---|
| 60 | Right Front Cable |
| 62 | Left Front Cable |
| 64 | Right Rear Cable |
| 66 | Left Rear Cable |
| 68 | Cable for Vertical Application |
| 70 | J-Hook |
| 72 | Horizontal J-Hook Receiver |
| 74 | Vertical J-Hook Receiver |
| 100 | Metal Building Under Construction |
| 105 | Purlin or Purlins |
| 110 | Crane |
| 115 | Crane Hook or Lift Point |

DETAILED DESCRIPTION OF THE INVENTION

Figure 17:
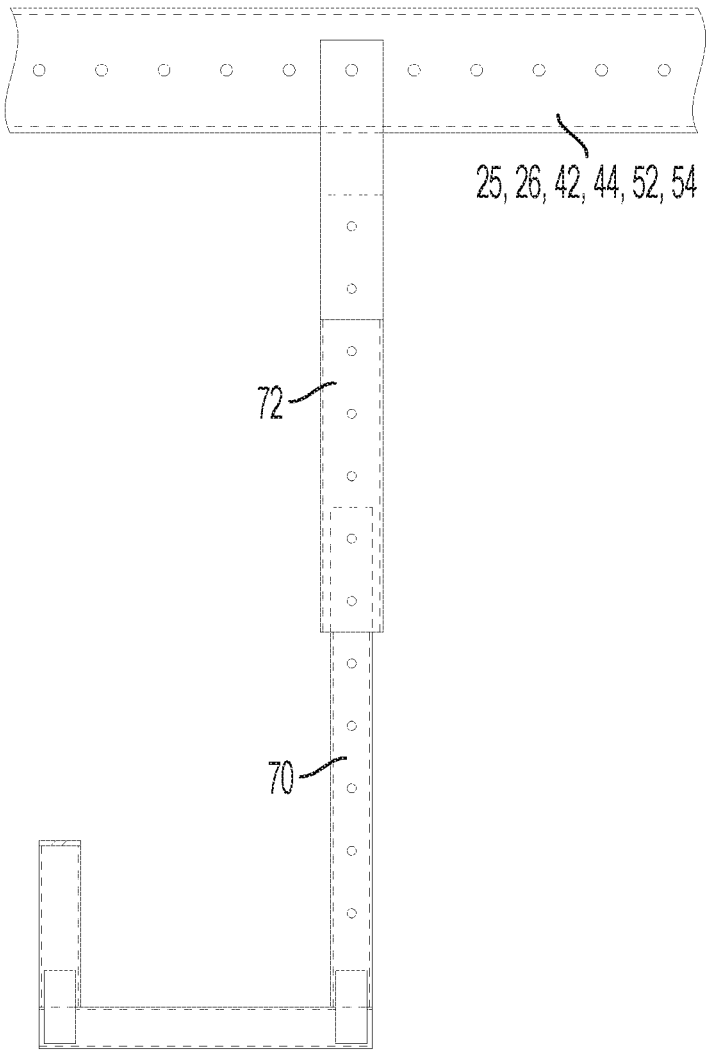
FIG. 17 is an enlarged front elevation view of J-hook and horizontal J-hook receiver.
Figure 18:
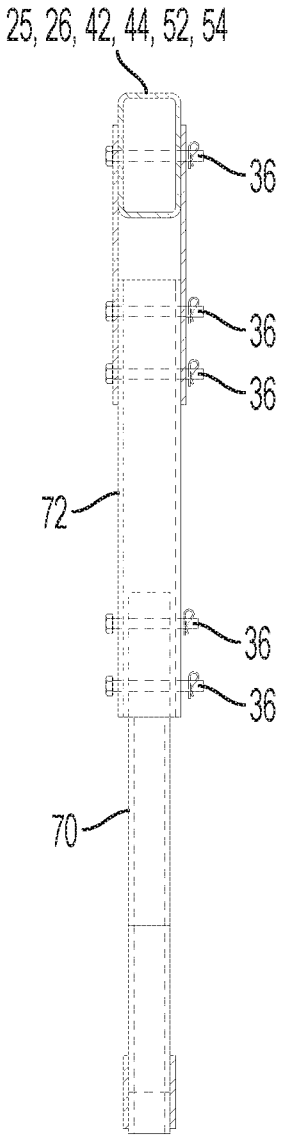
FIG. 18 is an enlarged right side elevation view of J-hook and horizontal J-hook receiver.
Figure 19:
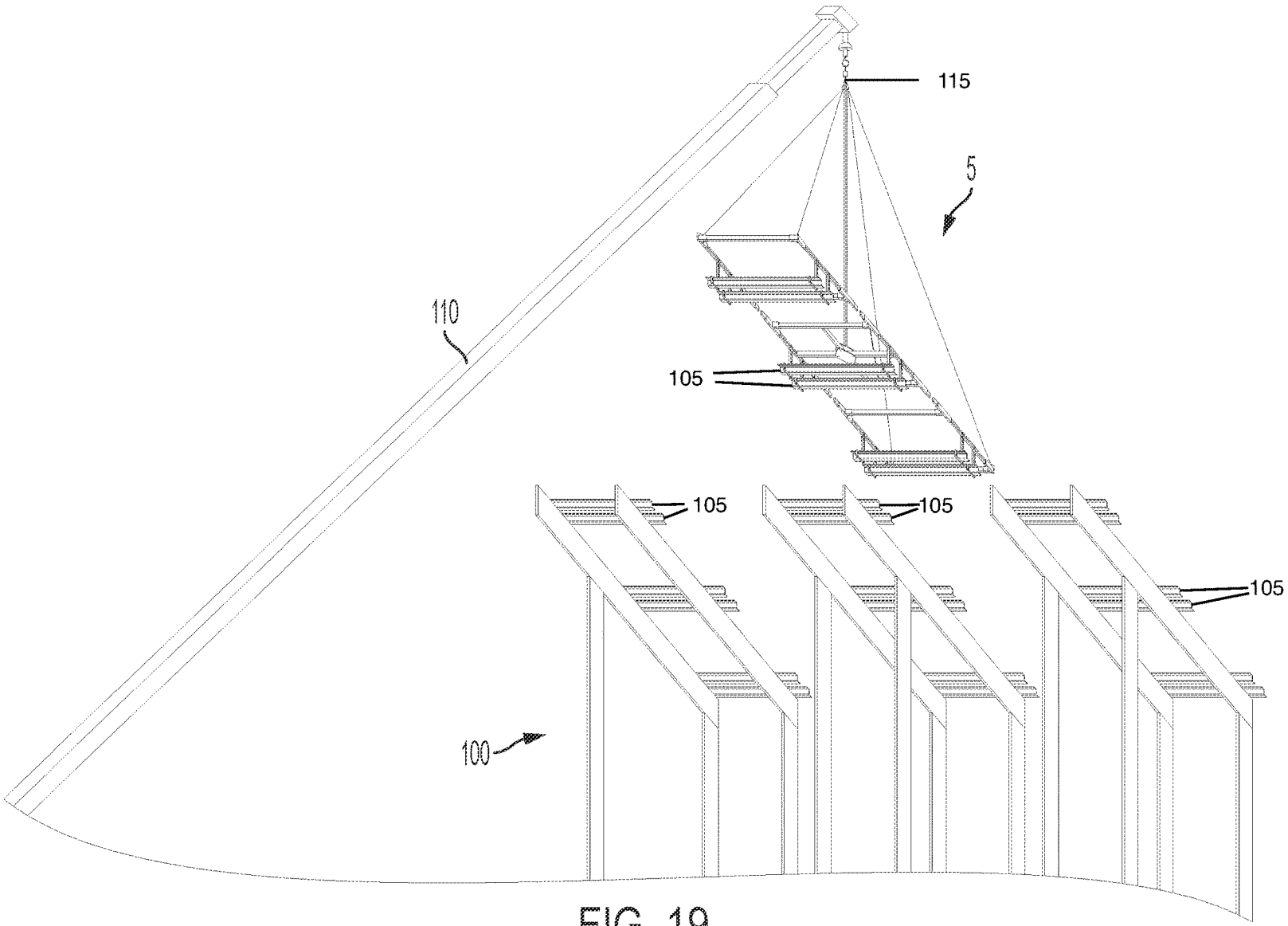
FIG. 19 is bottom perspective view of modular crane attachment device for purlins showing environmental items including purlins, a crane, and metal building under construction.
Figure 20:
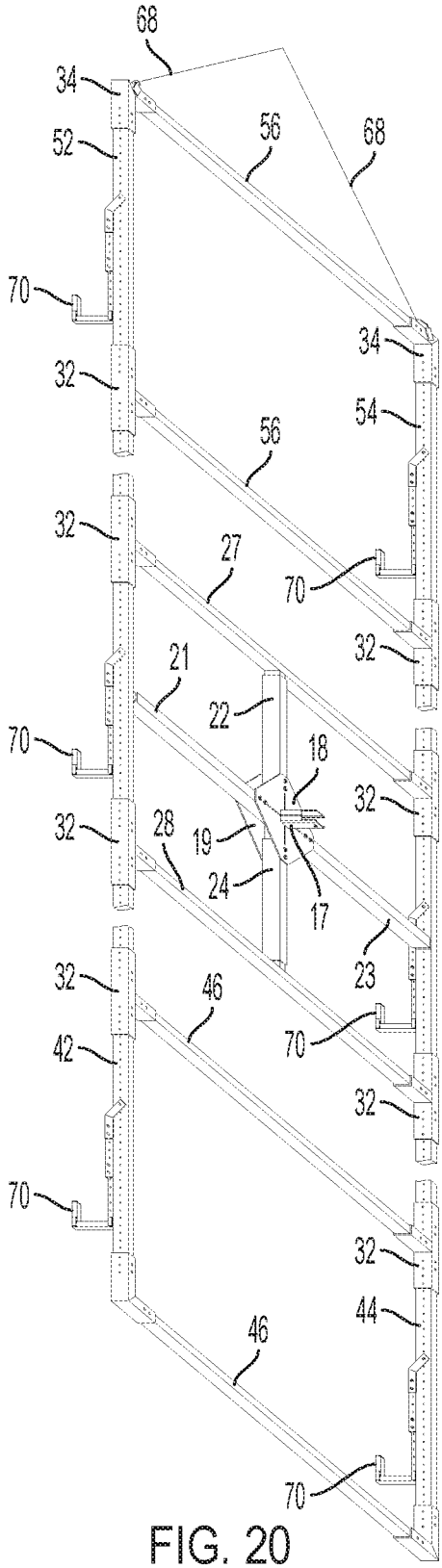
FIG. 20 is a perspective view of an alternate mode of modular crane attachment device for purlins depicting a vertical lift using modular crane attachment device for purlins.

Modular crane attachment device for purlins 5 may be used for horizontal lifts or vertical lifts. A horizontal lift is the standard primary application wherein the modular crane attachment device for purlins 5 is held by the crane 110 in a generally horizontal orientation with an angle or pitch. Horizontal applications are depicted in in FIGS. 1-14 and 17-19. Horizontal lifts are used to attach purlins 105 to a roof or rafters. A vertical lift is an application wherein the modular crane attachment device for purlins 5 is held by the crane 110 in a vertical orientation. Modular crane attachment device for purlins 5 is depicted in FIGS. 17, 18, and 20. Vertical lifts are used to attach wall members or cross members to a wall or studs.

Modular crane attachment device for purlins 5 comprises: a center section 20, a right section 40, a left section 50, a right front cable 60, a left front cable 62, a right rear cable 64, and a left rear cable 66. Modular crane attachment device for purlins 5 may further comprise one or more additional right sections 48 and/or one or more additional left sections 58.

Center section 20 comprises: a hoist post 10, a hoist post cap 11, a left lobe 13, a right lobe 15, a hoist post receiver 17, an upper hub plate 18, a lower hub plate 19, a center section front cross member 21, a center section left cross member 22, a center section rear cross member 23, a center section right cross member 24, a center section front spreader bar 25, a center section rear spreader bar 26, a center section left end member 27, a center section right end member 28, a left front T-splice fitting 32, a left rear T-splice fitting 32, a right front T-splice fitting 32, and a right rear T-splice fitting 32.

Hoist post 10 is a rigid oblong vertical member with an upper end, a lower end, a left surface, a right surface, a length, and a longitudinal axis. Hoist post 10 is a sturdy member that is capable of holding a large amount of weight without stretching, bending, or breaking. Hoist post 10 may be solid or made with tubular structure. Hoist post 10 has a length of about 10-30 feet. Hoist post 10 may be made of any known high strength material such as: steel, metal, carbon fiber, composite, or any other known high strength material. In best mode, hoist post 10 is made of tubular steel.

Hoist post cap 11 is a specially designed and specially constructed article. Hoist post cap 11 is rigidly attached to the upper end of hoist post 10. Hoist post cap 11 functions to provide an attachment point or lift point that is reversibly connectable to the hook or lift point 115 of a crane 110. Hoist post cap 11 comprises: horizontal member, a vertical member, a left gusset member, and a right gusset member. Horizontal member is a rigid horizontal planar member with an upper surface, a lower surface, a perimeter, and a slot or groove. Slot or groove is a slot or linear opening through horizontal member that does not break out to the edge or perimeter of horizontal member. Vertical member is rigid vertical planar member with an upper end, a lower end, a left surface, a right surface, and a longitudinal axis. The lower end of vertical member is sized and shaped to make a slip fit or clearance fit into the slot or groove on horizontal member and vice versa. To assemble hoist post cap 11, the lower end of vertical member is inserted through the slot or groove in the upper surface of horizontal member so that the lower end of vertical member protrudes through the lower surface of horizontal member and the horizontal member forms a right angle or ninety-degree angle with the vertical member wherein the longitudinal axes of hoist post 10 and vertical member are coincident. Then the protruded lower end of vertical member is rigidly attached to lower surface of horizontal member. Rigid attachment may be accomplished by any known means such as: weld, glue, epoxy, adhesive, bolts, screws, rivets, clips, or snaps. In best mode, rigid attachment is accomplished by one continuous weld around the entire lower end of vertical member. The upper end of vertical member has a hoist post cap lift hole 12. Hoist post cap lift hole 12 is a circular opening or hole in the upper end of vertical member. The hook or lift point 115 of a crane 110 is reversibly attachable to hoist post cap lift hole 12. Hoist post cap lift hole 12 is located above left and right gusset members. Left gusset member is a rigid vertical right triangle shaped planar member with a long side, a short side, a hypotenuse, and a longitudinal axis. The long side of left gusset member is rigidly attached to the left surface of vertical member. The short side of left gusset member is rigidly attached to the upper surface of horizontal member. The ninety-degree angle of the right triangle member is nested within and contiguous with the ninety-degree angle between the horizontal member and the vertical member wherein the longitudinal axes of hoist post 10 and left gusset member are parallel, as depicted. Rigid attachment may be accomplished by any known means such as: weld, glue, epoxy, adhesive, bolts, screws, rivets, clips, or snaps. In best mode, rigid attachment is accomplished by one continuous weld along the long and short sides of left gusset. Right gusset member is a rigid vertical right triangle shaped planar member with a long side, a short side, a hypotenuse, and a longitudinal axis. The long side of right gusset member is rigidly attached to the right surface of vertical member. The short side of right gusset member is rigidly attached to the upper surface of horizontal member. The ninety-degree angle of the right triangle member is nested within and contiguous with the ninety-degree angle between the horizontal member and the vertical member wherein the longitudinal axes of hoist post 10 and right gusset member are parallel, as depicted. Rigid attachment may be accomplished by any known means such as: weld, glue, epoxy, adhesive, bolts, screws, rivets, clips, or snaps. In best mode, rigid attachment is accomplished by one continuous weld along the long and short sides of right gusset. Vertical member, horizontal member, left gusset member, and right gusset member may be made of from any known rigid material such as: steel, metal, carbon fiber, composite, or any other known high strength material. In best mode, vertical member, horizontal member, left gusset member, and right gusset member are each made of steel sheet.

The hoist post cap 11 is rigidly attached to the upper end of hoist post 10. The lower surface of horizontal member of hoist post cap 11 is rigidly attached to the upper end of hoist post 10. Rigid attachment may be accomplished by any known means such as: weld, glue, epoxy, adhesive, bolts, screws, rivets, clips, or snaps. In best mode, rigid attachment is accomplished by one continuous weld around the full perimeter of horizontal member.

Left lobe 13 is a rigid vertical planar member with an upper half, a lower half, a right edge, a left edge, a front surface, a rear surface, and a longitudinal axis. Left lobe 13 is rigidly attached to the left surface of hoist post 10 just below hoist post cap 11, as depicted. Left lobe 13 functions to provide an attachment point for the left front cable 62 and the left rear cable 66 which function to help steady the load of purlins 105 during the lifting and setting of the load of purlins 105. The right edge of left lobe 13 is rigidly attached to the left surface of hoist post 10 so that the longitudinal axes of hoist post 10 and left lobe 13 are parallel. Rigid attachment may be accomplished by any known means such as: weld, glue, epoxy, adhesive, bolts, screws, rivets, clips, or snaps. In best mode, rigid attachment is accomplished by one continuous weld around the entire right edge of left lobe 13. The lower half of left lobe 13 has a left lobe hole 14. Left lobe hole 14 is a circular opening or hole in the lower end of left lobe 13.

Right lobe 15 is a rigid vertical planar member with an upper half, a lower half, a right edge, a left edge, a front surface, a rear surface, and a longitudinal axis. Right lobe 15 is rigidly attached to the right surface of hoist post 10 just below hoist post cap 11, as depicted. Right lobe 15 functions to provide an attachment point for the right front cable 60 and the right rear cable 64 which function to help steady the load of purlins 105 during the lifting and setting of the load of purlins 105. The left edge of right lobe 15 is rigidly attached to the right surface of hoist post 10 so that the longitudinal axes of hoist post 10 and right lobe 15 are parallel. Rigid attachment may be accomplished by any known means such as: weld, glue, epoxy, adhesive, bolts, screws, rivets, clips, or snaps. In best mode, rigid attachment is accomplished by one continuous weld around the entire left edge of right lobe 15. The lower half of right lobe 15 has a right lobe hole 16. Right lobe hole 16 is a circular opening or hole in the lower end of right lobe 15.

Hoist post receiver 17 is a rigid vertical member with an upper end, a lower end, a front surface, a left surface, a rear surface, a right surface, and a longitudinal axis. The lower end of hoist post receiver 17 is rigidly attached to the upper surface of upper hub plate 18 so that its longitudinal axis is perpendicular to the horizontal axis of upper hub plate 18. Rigid attachment may be accomplished by any known means such as: weld, glue, epoxy, adhesive, bolts, screws, rivets, clips, or snaps. In best mode, rigid attachment is accomplished by welding: a gusset between to the front surface of the lower end of hoist post receiver 17 and the upper surface of upper hub plate 18, a gusset between to the left surface of the lower end of hoist post receiver 17 and the upper surface of upper hub plate 18, a gusset between to the rear surface of the lower end of hoist post receiver 17 and the upper surface of upper hub plate 18, and a gusset between to the right surface of the lower end of hoist post receiver 17 and the upper surface of upper hub plate 18. The upper end of hoist post receiver 17 is reversibly pivotally attachable to the lower end of hoist post 10. Reversibly pivotal attachment may be accomplished by any known means. In best mode, reversible pivotal attachment is accomplished by a hinge member where the upper end of hoist post receiver 17 is a female hinge member with a horizontal hinge pin hole, the lower end of hoist post 10 is a male hinge member with a horizontal hinge pin hole, wherein the male hinge member is inserted into female hinge member to align their hinge pin holes where a heavy duty hinge pin is inserted therein to pivotally attach the lower end of hoist post 10 to the upper end of hoist post receiver 17. Hoist post receiver 17 may be made from any known rigid material such as: steel, metal, carbon fiber, composite, or any other known high strength material. In best mode, hoist post receiver 17 is made of tubular steel. Heavy duty hinge pin may be made of any known material such as: steel, metal, carbon fiber, composite, or any other known high strength material.

Upper hub plate 18 is a rigid planar member with an upper surface, a lower surface, a front end, a left end, a rear end, a right end, and a horizontal axis. The upper surface of upper hub plate 18 is rigidly attached to the lower end of hoist post receiver 17 as described above. Upper hub plate 18 may be made from any known rigid material such as: steel, metal, carbon fiber, composite, or any other known high strength material. In best mode, upper hub plate 18 is made of steel sheet.

Lower hub plate 19 is a rigid planar member with an upper surface, a lower surface, a front end, a left end, a rear end, a right end, and a horizontal axis. Lower hub plate 19 may be made from any known rigid material such as: steel, metal, carbon fiber, composite, or any other known high strength material. In best mode, lower hub plate 19 is made of steel sheet.

Center section front cross member 21 is a rigid oblong horizontal member with a front end, a rear end, an upper surface, a left surface, a lower surface, a right surface, a length, and a longitudinal axis. Length is about 2-10 feet. Center section front cross member 21 may be made from any known rigid material such as: steel, metal, carbon fiber, composite, or any other known high strength material. In best mode, center section front cross member 21 is made of tubular steel.

Center section left cross member 22 is a rigid oblong horizontal member with a left end, a right end, an upper surface, a rear surface, a lower surface, a front surface, a length, and a longitudinal axis. Length is about 2-15 feet. Center section left cross member 22 may be made from any known rigid material such as: steel, metal, carbon fiber, composite, or any other known high strength material. In best mode, center section left cross member 22 is made of tubular steel.

Center section rear cross member 23 is a rigid oblong horizontal member with a front end, a rear end, an upper surface, a left surface, a lower surface, a right surface, a length, and a longitudinal axis. Length is about 2-10 feet. Center section rear cross member 23 may be made from any known rigid material such as: steel, metal, carbon fiber, composite, or any other known high strength material. In best mode, center section rear cross member 23 is made of tubular steel.

Center section right cross member 24 is a rigid oblong horizontal member with a left end, a right end, an upper surface, a front surface, a lower surface, a rear surface, a length, and a longitudinal axis. Length is about 2-15 feet. Center section right cross member 24 may be made from any known rigid material such as: steel, metal, carbon fiber, composite, or any other known high strength material. In best mode, center section right cross member 24 is made of tubular steel.

Upper hub plate 18, lower hub plate 19, center section front cross member 21, center section left cross member 22, center section rear cross member 23, and center section right cross member 24 are reversibly attached or assembled together to form the base frame or structural integrity of center section 20. Upper hub plate 18, lower hub plate 19, center section front cross member 21, center section left cross member 22, center section rear cross member 23, and center section right cross member 24 are assembled together as follows.

The upper surface of the rear end of center section front cross member 21 is reversibly attached to the lower surface of upper hub plate 18 at the front end. The lower surface of the rear end of center section front cross member 21 is reversibly attached to the upper surface of lower hub plate 19 at the front end. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of upper hub plate 18, a vertical hole in the rear end of center section front cross member 21, and a vertical hole in the front end of lower hub plate 19 to attach these members together.

The upper surface of the right end of center section left cross member 22 is reversibly attached to the lower surface of upper hub plate 18 at the left end. The lower surface of the right end of center section left cross member 22 is reversibly attached to the upper surface of lower hub plate 19 at the left end. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of upper hub plate 18, a vertical hole in the right end of center section left cross member 22, and a vertical hole in the left end of lower hub plate 19 to attach these members together.

The upper surface of the front end of center section rear cross member 23 is reversibly attached to the lower surface of upper hub plate 18 at the rear end. The lower surface of the front end of center section rear cross member 23 is reversibly attached to the upper surface of lower hub plate 19 at the rear end. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of upper hub plate 18, a vertical hole in the front end of center section rear cross member 23, and a vertical hole in the rear end of lower hub plate 19 to attach these members together.

The upper surface of the left end of center section right cross member 24 is reversibly attached to the lower surface of upper hub plate 18 at the right end. The lower surface of the left end of center section right cross member 24 is reversibly attached to the upper surface of lower hub plate 19 at the right end. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of upper hub plate 18, a vertical hole in the left end of center section right cross member 24, and a vertical hole in the rear end of lower hub plate 19 to attach these members together.

The longitudinal axes of the center section front cross member 21 and the center section rear cross member 23 are coincident. The longitudinal axes of the center section left cross member 22 and the center section right cross member 24 are coincident. The longitudinal axes of the center section front cross member 21 and the center section rear cross member 23 are perpendicular to the longitudinal axes of the center section left cross member 22 and the center section right cross member 24, as depicted. The longitudinal axis of each cross member 21,22,23,24 is perpendicular to that of hoist post 10. The four cross members 21,22,23,24 attached to upper and lower plates 18,19 form a rigid cross-shaped assembly or rigid plus sign shaped assembly as depicted.

Center section front spreader bar 25 is a rigid oblong horizontal member with a left end, a right end, an upper surface, a front surface, a lower surface, a rear surface, a length, a mid-point, and a longitudinal axis. Length is about 5-20 feet. There is a plurality of horizontal holes in the front surface and the rear surface of center section front spreader bar 25 running uniformly along the entire length of the center section front spreader bar 25. Center section front spreader bar 25 may be made from any known rigid material such as: steel, metal, carbon fiber, composite, or any other known high strength material. In best mode, center section front spreader bar 25 is made of tubular steel.

Center section rear spreader bar 26 is a rigid oblong horizontal member with a left end, a right end, an upper surface, a front surface, a lower surface, a rear surface, a length, a mid-point, and a longitudinal axis. Length is about 5-20 feet. There is a plurality of horizontal holes in the front surface and the rear surface of center section rear spreader bar 26 running uniformly along the entire length of the center section rear spreader bar 26. Center section rear spreader bar 26 may be made from any known rigid material such as: steel, metal, carbon fiber, composite, or any other known high strength material. In best mode, center section front spreader bar 25 is made of tubular steel.

Center section left end member 27 is a rigid oblong horizontal member with a front end, a rear end, an upper surface, a left surface, a lower surface, a right surface, a length, a mid-point, and a longitudinal axis. Length is about 8-30 feet. Center section left end member 27 may be made from any known rigid material such as: steel, metal, carbon fiber, composite, or any other known high strength material. In best mode, center section left end member 27 is made of tubular steel.

Center section right end member 28 is a rigid oblong horizontal member with a front end, a rear end, an upper surface, a left surface, a lower surface, a right surface, a length, a mid-point, and a longitudinal axis. Length is about 8-30 feet. Center section right end member 28 may be made from any known rigid material such as: steel, metal, carbon fiber, composite, or any other known high strength material. In best mode, center section right end member 28 is made of tubular steel.

Each T-splice fitting 32 is a female by female by female T-shaped socket fitting or pipe fitting. Each T-splice fitting 32 is a rigid member. Each T-splice fitting 32 has three female sockets that form a T shape. Each T-splice fitting 32 has a base socket, a left socket, and a right socket to form the T shape. Base socket is at the base of the T shape. Left and right sockets are at the top of the T shape. T-splice fitting 32 may be made from any known rigid material such as: steel, metal, carbon fiber, composite, or any other known high strength material. In best mode, T-splice fitting 32 is made of tubular steel.

The left end of center section front spreader bar 25 slides into the left socket of the left front T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of center section front spreader bar 25 and a vertical hole the left socket of the left front T-splice fitting 32 to attach these members together. The right end of center section front spreader bar 25 slides into the right socket of the right front T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of center section front spreader bar 25 and a vertical hole the right socket of the right front T-splice fitting 32 to attach these members together. The front end of center section front cross member 21 is reversibly attachable to the rear surface of center section front spreader bar 25 at its midpoint. Reversible attachment may be accomplished by any know means such as: screws, bolts, fasteners, rivets, pins, clips, snaps. In best mode, reversible attachment is accomplished by sliding the front end of center section front cross member 21 over a rigid male protrusion extending outward from the rear surface of center section front spreader bar 25 at its midpoint with one or more removable vertical pins that each extend through a vertical hole in the front end of center section front cross member 21 and a vertical hole in the rigid male protrusion to attach these members together.

The left end of center section rear spreader bar 26 slides into the right socket of the left rear T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of center section rear spreader bar 26 and a vertical hole the right socket of the left rear T-splice fitting 32 to attach these members together. The right end of center section rear spreader bar 26 slides into the left socket of the right rear T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of center section rear spreader bar 26 and a vertical hole the left socket of the right rear T-splice fitting 32 to attach these members together. The rear end of center section rear cross member 23 is reversibly attachable to the front surface of center section rear spreader bar 26 at its midpoint. Reversible attachment may be accomplished by any know means such as: screws, bolts, fasteners, rivets, pins, clips, snaps. In best mode, reversible attachment is accomplished by sliding the rear end of center section rear cross member 23 over a rigid male protrusion extending outward from the front surface of center section rear spreader bar 26 at its midpoint with one or more removable vertical pins that each extend through a vertical hole in the rear end of center section rear cross member 23 and a vertical hole in the rigid male protrusion to attach these members together.

The front end of center section left end member 27 slides into the base socket of the left front T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of center section left end member 27 and a vertical hole the base socket of the left front T-splice fitting 32 to attach these members together. The rear end of center section left end member 27 slides into the base socket of the left rear T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of center section left end member 27 and a vertical hole the base socket of the left rear T-splice fitting 32 to attach these members together. The left end of center section left cross member 22 is reversibly attachable to the right surface of center section left end member 27 at its midpoint. Reversible attachment may be accomplished by any know means such as: screws, bolts, fasteners, rivets, pins, clips, snaps. In best mode, reversible attachment is accomplished by sliding the left end of center section left cross member 22 over a rigid male protrusion extending outward from the right surface of center section left end member 27 at its midpoint with one or more removable vertical pins that each extend through a vertical hole in the left end of center section left cross member 22 and a vertical hole in the rigid male protrusion to attach these members together.

The front end of center section right end member 28 slides into the base socket of the right front T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of center section right end member 28 and a vertical hole the base socket of the right front T-splice fitting 32 to attach these members together. The rear end of center section right end member 28 slides into the base socket of the right rear T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of center section right end member 28 and a vertical hole the base socket of the right rear T-splice fitting 32 to attach these members together. The right end of center section right cross member 24 is reversibly attachable to the left surface of center section right end member 28 at its midpoint. Reversible attachment may be accomplished by any know means such as: screws, bolts, fasteners, rivets, pins, clips, snaps. In best mode, reversible attachment is accomplished by sliding the right end of center section right cross member 24 over a rigid male protrusion extending outward from the left surface of center section right end member 28 at its midpoint with one or more removable vertical pins that each extend through a vertical hole in the right end of center section right cross member 24 and a vertical hole in the rigid male protrusion to attach these members together.

Right section 40 comprises: a right section front spreader bar 42, a right section rear spreader bar 44, a right section end member 46, a front corner splice fitting 34, and a rear corner splice fitting 34.

Right section front spreader bar 42 is a rigid oblong horizontal member with a left end, a right end, an upper surface, a front surface, a lower surface, a rear surface, a length, a mid-point, and a longitudinal axis. Length is about 5-20 feet. There is a plurality of horizontal holes in the front surface and the rear surface of right section front spreader bar 42 running uniformly along the entire length of the right section front spreader bar 42. Right section front spreader bar 42 may be made from any known rigid material such as: steel, metal, carbon fiber, composite, or any other known high strength material. In best mode, right section front spreader bar 42 is made of tubular steel.

Right section rear spreader bar 44 is a rigid oblong horizontal member with a left end, a right end, an upper surface, a front surface, lower surface, a rear surface, a length, a mid-point, and a longitudinal axis. Length is about 5-20 feet. There is a plurality of horizontal holes in the front surface and the rear surface of right section rear spreader bar 44 running uniformly along the entire length of the right section rear spreader bar 44. Right section rear spreader bar 44 may be made from any known rigid material such as: steel, metal, carbon fiber, composite, or any other known high strength material. In best mode, right section front spreader bar 42 is made of tubular steel.

Right section end member 46 is a rigid oblong horizontal member with a front end, a rear end, an upper surface, a left surface, a lower surface, a right surface, a length, a mid-point, and a longitudinal axis. Length is about 8-30 feet. Right section end member 46 may be made from any known rigid material such as: steel, metal, carbon fiber, composite, or any other known high strength material. In best mode, right section end member 46 is made of tubular steel.

Each corner splice fitting 34 is a female by female elbow or ninety-degree socket fitting or pipe fitting with an outer dimension and an inner dimension. Each corner splice fitting 34 is a rigid member. Each corner splice fitting 34 has two female sockets that form an L shape. Each corner splice fitting 34 has a first socket and a second socket to form the L shape. First and second sockets lie in a horizontal plane. Each corner splice fitting 34 has a corner lift plate rigidly attached thereto. Corner lift plate is a rigid vertical planar member with a large hole or void and a small hole or void in its center or interior section. The inner dimension of the large hole is slightly larger than the outer dimension of corner splice fitting 34. To attach corner lift plate to corner splice fitting 34, corner splice fitting 34 is inserted through the large hole so that the corner plate straddles the 90 degree section or corner section of corner splice fitting 34 wherein the corner lift plate protrudes vertically upwards from the horizontally positioned corner splice fitting 34 while at a 45-degree angle at the center of the elbow shape. In this position, corner plate is rigidly attached to corner splice fitting 34 by a full perimeter weld around the entire perimeter of large hole. The small hole on corner lift plate is located on the section of corner plate that protrudes vertically upwards from the horizontally positioned corner splice fitting 34. There must be sufficient corner lift plate material left around this small hole to provide the small hole with great tensile strength. This small hole is a lift hole. Each corner splice fitting 34 has a lift hole. Lift holes are used to attach to the lower ends of cables 60,62,64,66 as described below. Corner splice fitting 34 and corner lift plate may be made from any known rigid material such as: steel, metal, carbon fiber, composite, or any other known high strength material. In best mode, corner splice fitting 34 is made of tubular steel and lift plate is made of steel sheet.

The left end of right section front spreader bar 42 slides into the left socket of the right front T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of right section front spreader bar 42 and a vertical hole the left socket of the right front T-splice fitting 32 to attach these members together. The right end of right section front spreader bar 42 slides into the first socket of the front corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of right section front spreader bar 42 and a vertical hole the first socket of the front corner splice fitting 34 to attach these members together.

The left end of right section rear spreader bar 44 slides into the right socket of the right rear T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of right section rear spreader bar 44 and a vertical hole the right socket of the right rear T-splice fitting 32 to attach these members together. The right end of right section rear spreader bar 44 slides into the first socket of the rear corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of right section rear spreader bar 44 and a vertical hole the first socket of the rear corner splice fitting 34 to attach these members together.

The front end of right section end member 46 slides into the second socket of the front corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of right section end member 46 and a vertical hole the second socket of the front corner splice fitting 34 to attach these members together. The rear end of right section end member 46 slides into the second socket of the rear corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of right section end member 46 and a vertical hole the second socket of the rear corner splice fitting 34 to attach these members together.

Modular crane attachment device for purlins 5 may further comprise one or more additional right sections 48. One or more additional right sections 48 are located in between center section 20 and right section 40. Additional right sections 48 use T-spice fittings 32 instead of corner splice fittings 34 on the end to provide room for the attachment of the right section 40 or additional right sections 48. There is always one center section 20 and one right section 40. Optionally, there may be a plurality of additional right sections 48 there between. Each additional right section 48 comprises: a right section front spreader bar 42, a right section rear spreader bar 44, a right section end member 46, a front T-splice fitting 32, and a rear T-splice fitting 32. Additional right sections 48 are assembled as follows.

The left end of right section front spreader bar 42 slides into the left socket of the right front T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of right section front spreader bar 42 and a vertical hole the left socket of the right front T-splice fitting 32 to attach these members together. The right end of right section front spreader bar 42 slides into the right socket of the front T-splice fitting 32 on right section 40 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of right section front spreader bar 42 and a vertical hole the right socket of the front T-splice fitting 32 to attach these members together.

The left end of right section rear spreader bar 44 slides into the right socket of the right rear T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of right section rear spreader bar 44 and a vertical hole the right socket of the right rear T-splice fitting 32 to attach these members together. The right end of right section rear spreader bar 44 slides into the left socket of the rear T-splice fitting 32 on right section 40 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of right section rear spreader bar 44 and a vertical hole the left socket of the rear T-splice fitting 32 to attach these members together.

The front end of right section end member 46 slides into the base socket of the front T-splice fitting 32 on right section 40 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of right section end member 46 and a vertical hole the base socket of the front T-splice fitting 32 to attach these members together. The open left socket on front T-splice fitting 32 is used to attach the right section 40 or additional right sections 48 as described above. The rear end of right section end member 46 slides into the base socket of the rear T-splice fitting 32 on right section 40 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of right section end member 46 and a vertical hole the base socket of the rear T-splice fitting 32 to attach these members together. The open right socket on rear T-splice fitting 32 is used to attach the right section 40 or additional right sections 48 as described above.

Left section 50 comprises: a left section front spreader bar 52, a left section rear spreader bar 54, a left section end member 56, a front corner splice fitting 34, and a rear corner splice fitting 34.

Left section front spreader bar 52 is a rigid oblong horizontal member with a left end, a right end, an upper surface, a front surface, a lower surface, a rear surface, a length, a mid-point, and a longitudinal axis. Length is about 5-20 feet. There is a plurality of horizontal holes in the front surface and the rear surface of left section front spreader bar 52 running uniformly along the entire length of the left section front spreader bar 52. Left section front spreader bar 52 may be made from any known rigid material such as: steel, metal, carbon fiber, composite, or any other known high strength material. In best mode, left section front spreader bar 52 is made of tubular steel.

Left section rear spreader bar 54 is a rigid oblong horizontal member with a left end, a right end, an upper surface, a front surface, a lower surface, a rear surface, a length, a mid-point, and a longitudinal axis. Length is about 5-20 feet. There is a plurality of horizontal holes in the front surface and the rear surface of left section rear spreader bar 54 running uniformly along the entire length of the left section rear spreader bar 54. Left section rear spreader bar 54 may be made from any known rigid material such as: steel, metal, carbon fiber, composite, or any other known high strength material. In best mode, left section rear spreader bar 54 is made of tubular steel.

Left section end member 56 is a rigid oblong horizontal member with a front end, a rear end, an upper surface, a left surface, a lower surface, a right surface, a length, a mid-point, and a longitudinal axis. Length is about 8-30 feet. Left section end member 56 may be made from any known rigid material such as: steel, metal, carbon fiber, composite, or any other known high strength material. In best mode, left section end member 56 is made of tubular steel.

Each corner splice fitting 34 is a female by female elbow or ninety-degree socket fitting or pipe fitting with an outer dimension and an inner dimension. Each corner splice fitting 34 is a rigid member. Each corner splice fitting 34 has two female sockets that form an L shape. Each corner splice fitting 34 has a first socket and a second socket to form the L shape. First and second sockets lie in a horizontal plane. Each corner splice fitting 34 has a corner lift plate rigidly attached thereto. Corner lift plate is a rigid vertical planar member with a large hole or void and a small hole or void in its center or interior section. The inner dimension of the large hole is slightly larger than the outer dimension of corner splice fitting 34. To attach corner lift plate to corner splice fitting 34, corner splice fitting 34 is inserted through the large hole so that the corner plate straddles the 90 degree section or corner section of corner splice fitting 34 wherein the corner lift plate protrudes vertically upwards from the horizontally positioned corner splice fitting 34 while at a 45-degree angle at the center of the elbow shape. In this position, corner plate is rigidly attached to corner splice fitting 34 by a full perimeter weld around the entire perimeter of large hole. The small hole on corner lift plate is located on the section of corner plate that protrudes vertically upwards from the horizontally positioned corner splice fitting 34. There must be sufficient corner lift plate material left around this small hole to provide the small hole with great tensile strength. This small hole is a lift hole. Each corner splice fitting 34 has a lift hole. Lift holes are used to attach to the lower ends of cables 60,62,64,66 as described below. Corner splice fitting 34 and corner lift plate may be made from any known rigid material such as: steel, metal, carbon fiber, composite, or any other known high strength material. In best mode, corner splice fitting 34 is made of tubular steel and lift plate is made of steel sheet.

The right end of left section front spreader bar 52 slides into the right socket of the left front T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of left section front spreader bar 52 and a vertical hole the right socket of the left front T-splice fitting 32 to attach these members together. The left end of left section front spreader bar 52 slides into the first socket of the front corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of left section front spreader bar 52 and a vertical hole the first socket of the front corner splice fitting 34 to attach these members together.

The right end of left section rear spreader bar 54 slides into the left socket of the left rear T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of left section rear spreader bar 54 and a vertical hole the left socket of the left rear T-splice fitting 32 to attach these members together. The left end of left section rear spreader bar 54 slides into the first socket of the rear corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of left section rear spreader bar 54 and a vertical hole the first socket of the rear corner splice fitting 34 to attach these members together.

The front end of left section end member 56 slides into the second socket of the front corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of left section end member 56 and a vertical hole the second socket of the front corner splice fitting 34 to attach these members together. The rear end of left section end member 56 slides into the second socket of the rear corner splice fitting 34 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of left section end member 56 and a vertical hole the second socket of the rear corner splice fitting 34 to attach these members together.

Modular crane attachment device for purlins 5 may further comprise one or more additional left sections 58. One or more additional left sections 58 are located in between center section 20 and left section 50. Additional left sections 58 use T-spice fittings 32 instead of corner splice fittings 34 on the end to provide room for the attachment of the left section 50 or additional left sections 58. There is always one center section 20 and one left section 50. Optionally, there may be a plurality of additional left sections 58 there between. Each additional left section 58 comprises: a left section front spreader bar 52, a left section rear spreader bar 54, a left section end member 56, a front T-splice fitting 32, and a rear T-splice fitting 32. Additional left sections 58 are assembled as follows.

The right end of left section front spreader bar 52 slides into the right socket of the left front T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the right end of left section front spreader bar 52 and a vertical hole the right socket of the front right T-splice fitting 32 to attach these members together. The left end of left section front spreader bar 52 slides into the left socket of the front T-splice fitting 32 on left section 50 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of left section front spreader bar 52 and a vertical hole the left socket of the front T-splice fitting 32 to attach these members together.

The right end of left section rear spreader bar 54 slides into the left socket of the left rear T-splice fitting 32 on center section 20 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of right section rear spreader bar 44 and a vertical hole the right socket of the left rear T-splice fitting 32 to attach these members together. The left end of left section rear spreader bar 54 slides into the right socket of the rear T-splice fitting 32 on left section 50 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the left end of left section rear spreader bar 54 and a vertical hole the right socket of the rear T-splice fitting 32 to attach these members together.

The front end of left section end member 56 slides into the base socket of the front T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the front end of left section end member 56 and a vertical hole the base socket of the front T-splice fitting 32 to attach these members together. The open right socket on front T-splice fitting 32 is used to attach the left section 50 or additional left sections 58 as described above. The rear end of left section end member 56 slides into the base socket of the rear T-splice fitting 32 and is reversibly attachable thereto. Reversible attachment may be accomplished by any know means such as: screws, bolts, fasteners, rivets, pins, clips, snaps. In best mode, reversible attachment is accomplished by one or more removable vertical pins that each extend through a vertical hole in the rear end of left section end member 56 and a vertical hole the base socket of the rear T-splice fitting 32 to attach these members together. The open left socket of rear T-splice fitting 32 is used to attach the left section 50 or additional left sections 58 as described above.

Right front cable 60, left front cable 62, right rear cable 64, and left rear cable 66 are each a length of cable or thick rope of wire or nonmetallic fiber with an upper end and a lower end. The lower end of right front cable 60 is reversibly attachable to the lift hole on the front corner splice fitting 34 of right section 40. The lower end of right rear cable 64 is reversibly attachable to the lift hole on the rear corner splice fitting 34 of right section 40. The lower end of left front cable 62 is reversibly attachable to the lift hole on the front corner splice fitting 34 of left section 50. The lower end of left rear cable 66 is reversibly attachable to the lift hole on the rear corner splice fitting 34 of left section 50. The upper end of right front cable 60 is reversibly attachable to right lobe hole 16. The upper end of right rear cable 64 is reversibly attachable to right lobe hole 16. The upper end of left front cable 62 is reversibly attachable to left lobe hole 14. The upper end of left rear cable 66 is reversibly attachable to left lobe hole 14. Reversible attachment may be accomplished by any know means such as by hook, ring, clevis, shackle, or similar. The length of right front cable 60, left front cable 62, right rear cable 64, and left rear cable 66 must be adjusted so that the cables are without slack and under tension when attached. Right front cable 60 and right rear cable 64 function to carry load or weight from the right section 40 as modular crane attachment device for purlins 5 is being used to lift a plurality of purlins in the air. Left front cable 62 and left rear cable 66 function to carry load or weight from the left section 50 as modular crane attachment device for purlins 5 is being used to lift a plurality of purlins in the air. Center section 20, right section 40, and left section 50 are assembled together to form an overall planar assembly as depicted. Since hoist post 10 is pivotally attached to hoist post receiver 17, the overall planar assembly of center section 20, right section 40, and left section 50 may be tilted to any pitch or angle to match the pitch or angle of the roof of the building 100. The length of right front cable 60, left front cable 62, right rear cable 64, and left rear cable 66 may be adjusted to match this pitch or angle so that the desired pitch or angle may be maintained during the lift a plurality of purlins in the air.

Modular crane attachment device for purlins 5 further comprises: a plurality of J-hooks 70 and a plurality of horizontal J-hook receivers 72 or a plurality of vertical J-hook receivers 74. Modular crane attachment device for purlins 5 uses either horizontal J-hook receivers 72 or vertical J-hook receivers 74 at any one time. Modular crane attachment device for purlins 5 utilizes horizontal J-hook receivers 72 to conduct horizontal lifts wherein the modular crane attachment device for purlins 5 is held by the crane 110 in a generally horizontal orientation. Modular crane attachment device for purlins 5 is depicted with horizontal J-hook receivers 72 in FIGS. 1-14 and 17-19. Horizontal lifts are used to attach purlins 105 to a roof. Modular crane attachment device for purlins 5 utilizes vertical J-hook receivers 74 to conduct vertical lifts wherein the modular crane attachment device for purlins 5 is held by the crane 110 in a generally vertical orientation. Modular crane attachment device for purlins 5 is depicted with vertical J-hook receivers 74 in FIGS. 17,18, and 20. Vertical lifts are used to attach wall members or cross members to a wall.

Each J-hook 70 is a rigid J-shaped member, hook member, or hook shaped member. Each J-hook 70 comprises: a long vertical member, a horizontal member, and a short vertical member. Long vertical member is a rigid oblong vertical member with an upper end, a lower end, an outer dimension, a length, and a longitudinal axis. Long vertical member has a length of about 1-6 feet. Long vertical member has a plurality of holes spaced along its entire length. Long vertical member may be made from any known rigid material such as: steel, metal, carbon fiber, composite, or any other known high strength material. In best mode, long vertical member is made of tubular steel. Horizontal member is a rigid oblong horizontal member with a left end, a right end, a length, and a longitudinal axis. Horizontal member has a length of about 3-30 inches. Horizontal member may be made from any known rigid material such as: steel, metal, carbon fiber, composite, or any other known high strength material. In best mode, horizontal member is made of tubular steel. Short vertical member is a rigid oblong vertical member with an upper end, a lower end, a length, and a longitudinal axis. Short vertical member has a length of about 3-30 inches. Short vertical member may be made from any known rigid material such as: steel, metal, carbon fiber, composite, or any other known high strength material. In best mode, short vertical member is made of tubular steel. The lower end of long vertical member is rigidly attached to the right end of horizontal member. The left end of horizontal member is rigidly attached to the lower end of short vertical member. The longitudinal axes of long and short vertical members are parallel and perpendicular to the longitudinal axis of horizontal member to form the J-shape. Rigid attachment may be accomplished by any known means such as: weld, glue, epoxy, adhesive, bolts, screws, rivets, clips, or snaps. In best mode, rigid attachment is accomplished by welding.

Each horizontal J-hook receiver 72 is a rigid oblong vertical member with an upper end, a lower end, a front surface, a left surface, a rear surface, a right surface, a length, and a longitudinal axis. Horizontal J-hook receiver 72 has a length of about 1-6 feet. Horizontal J-hook receiver 72 has a plurality of holes spaced along its entire length. There is a plurality of holes in the front surface and the rear surface of horizontal J-hook receiver 72. The upper end of horizontal J-hook receiver 72 has two rigid tabs or ears with a hole in each tab or ear. The upper end of Horizontal J-hook receiver 72 is reversibly pivotally attachable to: center section front spreader bar 25, center section rear spreader bar 26, any right section front spreader bar 42, any right section rear spreader bar 44, any left section front spreader bar 52, or any left section rear spreader bar 54. Reversible pivotal attachment may be accomplished by any known means. In best mode, reversible pivotal attachment is accomplished by aligning the two holes in the upper end of Horizontal J-hook receiver 72 with two holes in: center section front spreader bar 25, center section rear spreader bar 26, any right section front spreader bar 42, any right section rear spreader bar 44, any left section front spreader bar 52, or any left section rear spreader bar 54, and then inserting a hinge pin or pin 36 through the four holes to create a pivotal attachment between these members that pivots about the hinge pin. This attachment is depicted in FIGS. 17 and 18. A horizontal J-hook receiver 72 may be pivotally attached to any position along the lengths of center section front spreader bar 25, center section rear spreader bar 26, any right section front spreader bar 42, any right section rear spreader bar 44, any left section front spreader bar 52, or any left section rear spreader bar 54 because there is a plurality of holes along these members as described above. In this way, modular crane attachment device for purlins 5 may be customized to fit any size building 100 with any required purlin-to-purlin distance. The lower end of horizontal J-hook receiver 72 has an open-ended tubular shape. The lower end of horizontal J-hook receiver 72 has an inner dimension or overall inner dimension that is slightly larger than the outer dimension of the long vertical member of J-hook 70. The lower end of Horizontal J-hook receiver 72 is reversibly attachable to the upper end of long vertical member of J-hook 70. Reversibly attachment may be accomplished by any known means. In best mode, reversibly attachment is accomplished by inserting the upper end of long vertical member of J-hook 70 into the open end of the lower end of horizontal J-hook receiver 72 to align a hole on long vertical member of J-hook 70 with two holes in horizontal J-hook receiver 72, one hole on its front surface and one hole on its rear surface, and then inserting a hinge pin or pin 36 through the holes to attach these members, as depicted in FIGS. 17 and 18. A J-hook 70 may be attached to horizontal J-hook receiver 72 at multiple locations or multiple lengths because there is a plurality of holes along the length of the long vertical member of J-hook 70 where any one could be used to align with a plurality of holes along the length of horizontal J-hook receiver 72 for attachment thereto. Horizontal J-hook receiver 72 may be made from any known rigid material such as: steel, metal, carbon fiber, composite, or any other known high strength material. In best mode, horizontal J-hook receiver 72 is made of tubular steel.

In order to use modular crane attachment device for purlins 5 to conduct standard horizontal lifts and to raise a plurality of purlins, the modular crane attachment device for purlins 5 is assembled as described above, wherein the required amount of left and right sections 40,48,50,58 is used to allow for the attachment of the desired amount of J-hooks 70 to attach the desired amount of purlins 105 to building 100. The crane hook 115 is attached to hoist post cap lift hole 12 and modular crane attachment device for purlins 5 is lifted off the ground and held in a horizontal position near the purlin supply pile on the job site. The desired amount of J-hooks 70 is then attached to spreader bars 25,26,42,44,52,54 using a horizontal J-hook receiver for each J-hook 70. Typically, two J-hooks 70 are required to lift one purlin 105. The J-hooks must be position exactly as required to mate with the particular rafters or roof of building 100. The desired amount of purlins 105 is then loaded onto the J-hooks 70 by placing the purlin 105 in the cradle section of the J-shape. The load of purlins is then raised up to the building 100 by the crane 110 and placed into the exact position or close proximity required for immediate attachment to the roof or rafters. Workers then attach all rafters. The modular crane attachment device for purlins 5 may be lowered to lift each purlin out of the cradle section of the J-hook 70 after placement to allow clearance. The empty modular crane attachment device for purlins 5 is then lifted away from the roof and lowered back to the purlin supply pile where the process is repeated until all purlins are attached to the roof or rafters.

Figure 1:
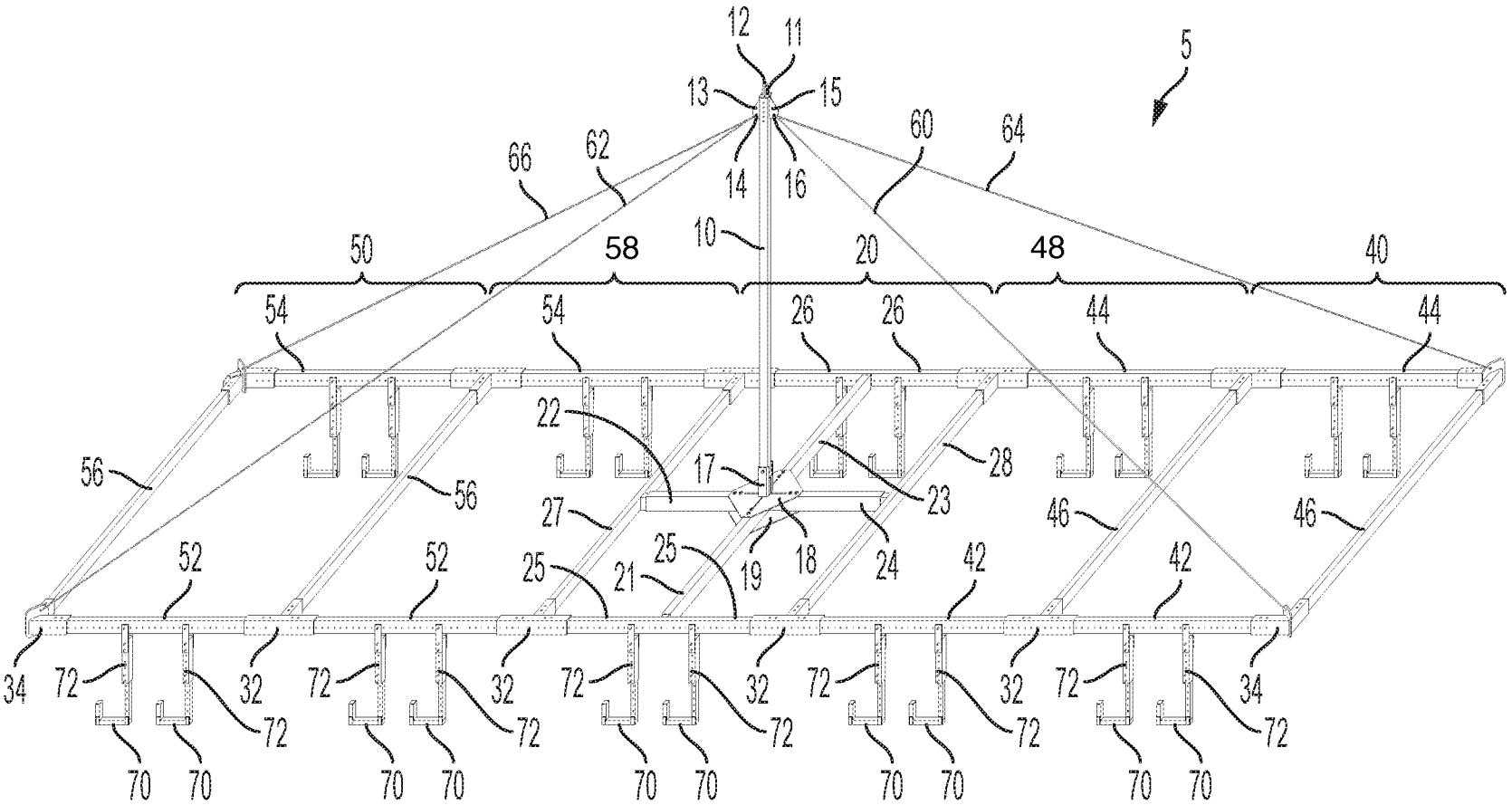
FIG. 1 is a perspective view of modular crane attachment device for purlins.
Figure 2A:
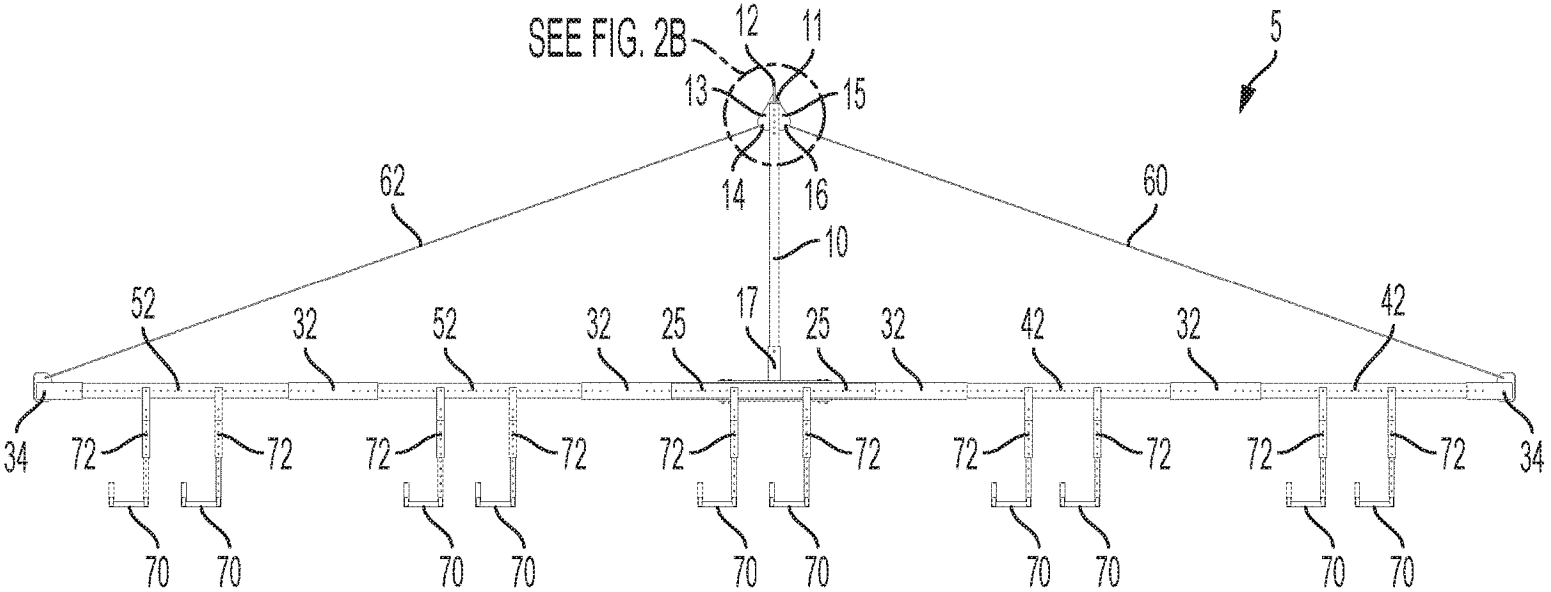
FIG. 2A is a front elevation view of modular crane attachment device for purlins.
Figure 2B:
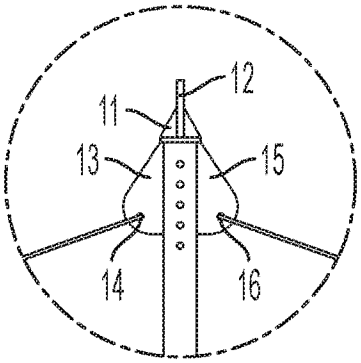
FIG. 2B is an enlarged view of hoist post cap, left lobe, and right lobe.
Figure 3:
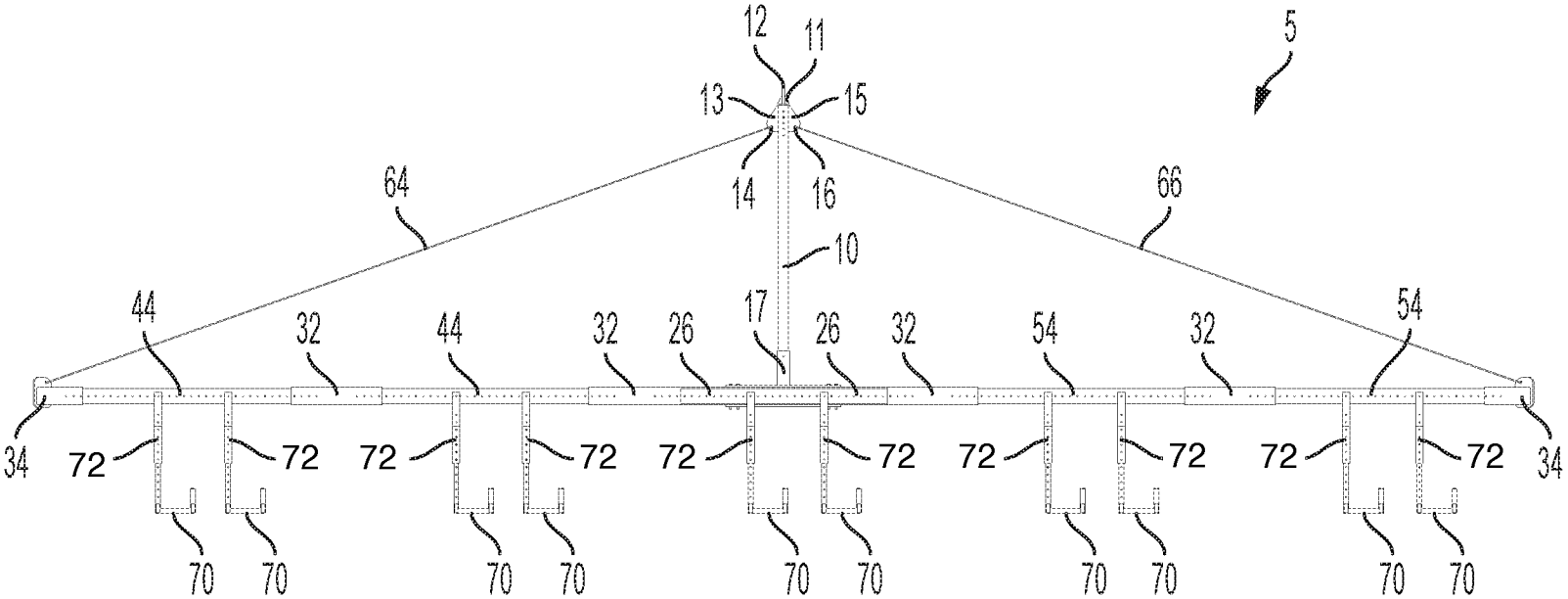
FIG. 3 is a rear elevation view of modular crane attachment device for purlins.
Figure 4:
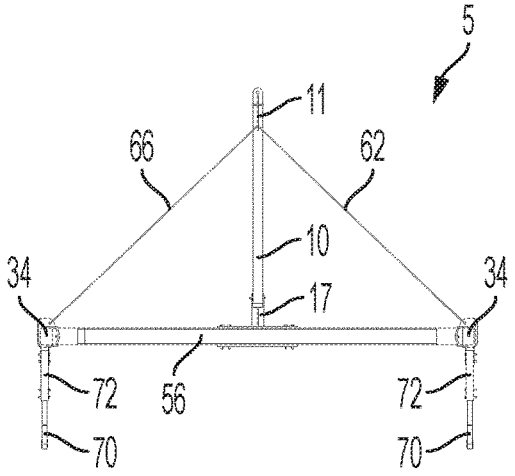
FIG. 4 is a left side elevation view of modular crane attachment device for purlins.
Figure 5:
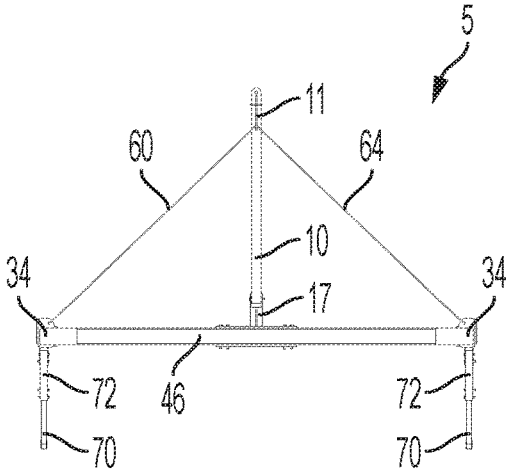
FIG. 5 is a right side elevation view of modular crane attachment device for purlins.
Figure 6:
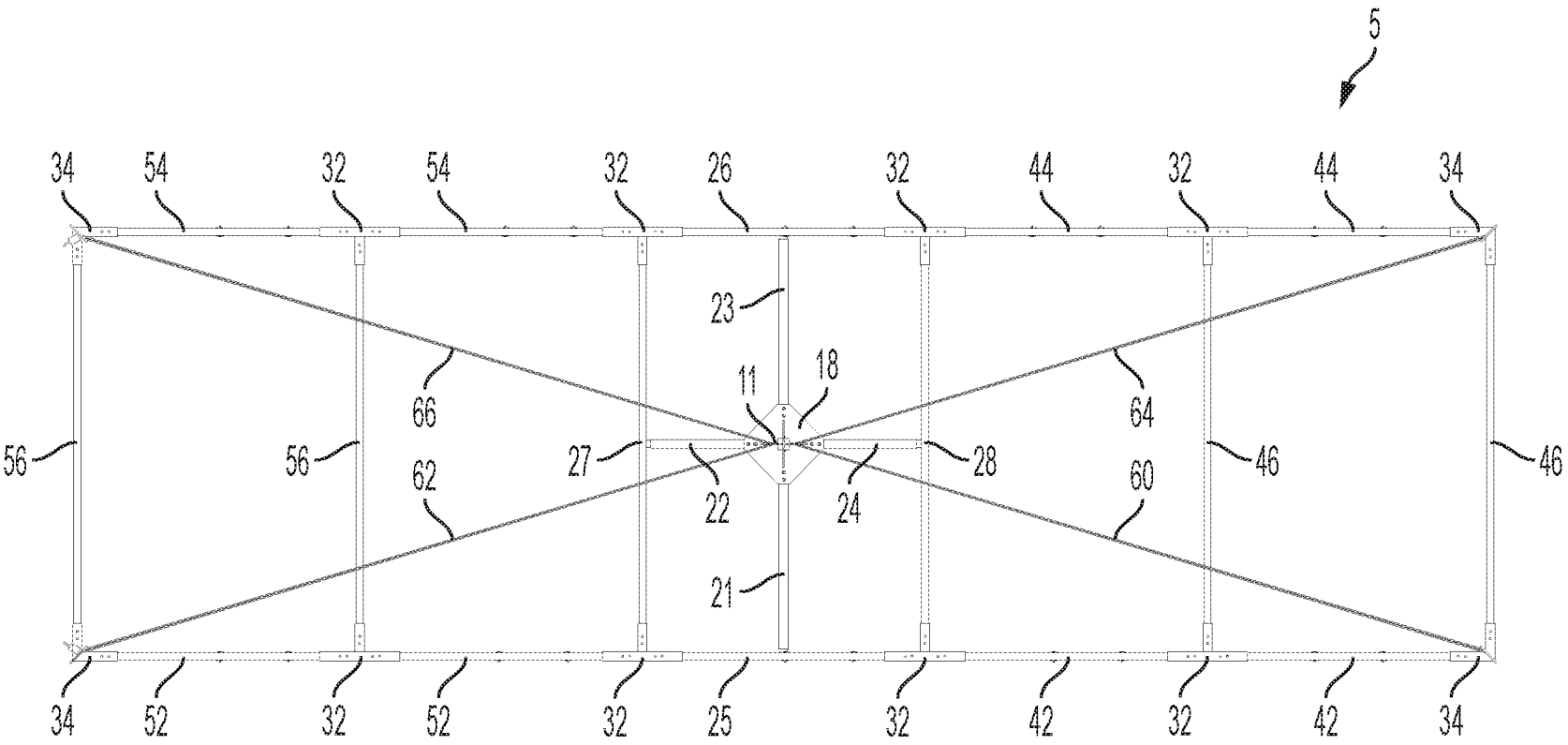
FIG. 6 is a top plan view of modular crane attachment device for purlins.
Figure 7:
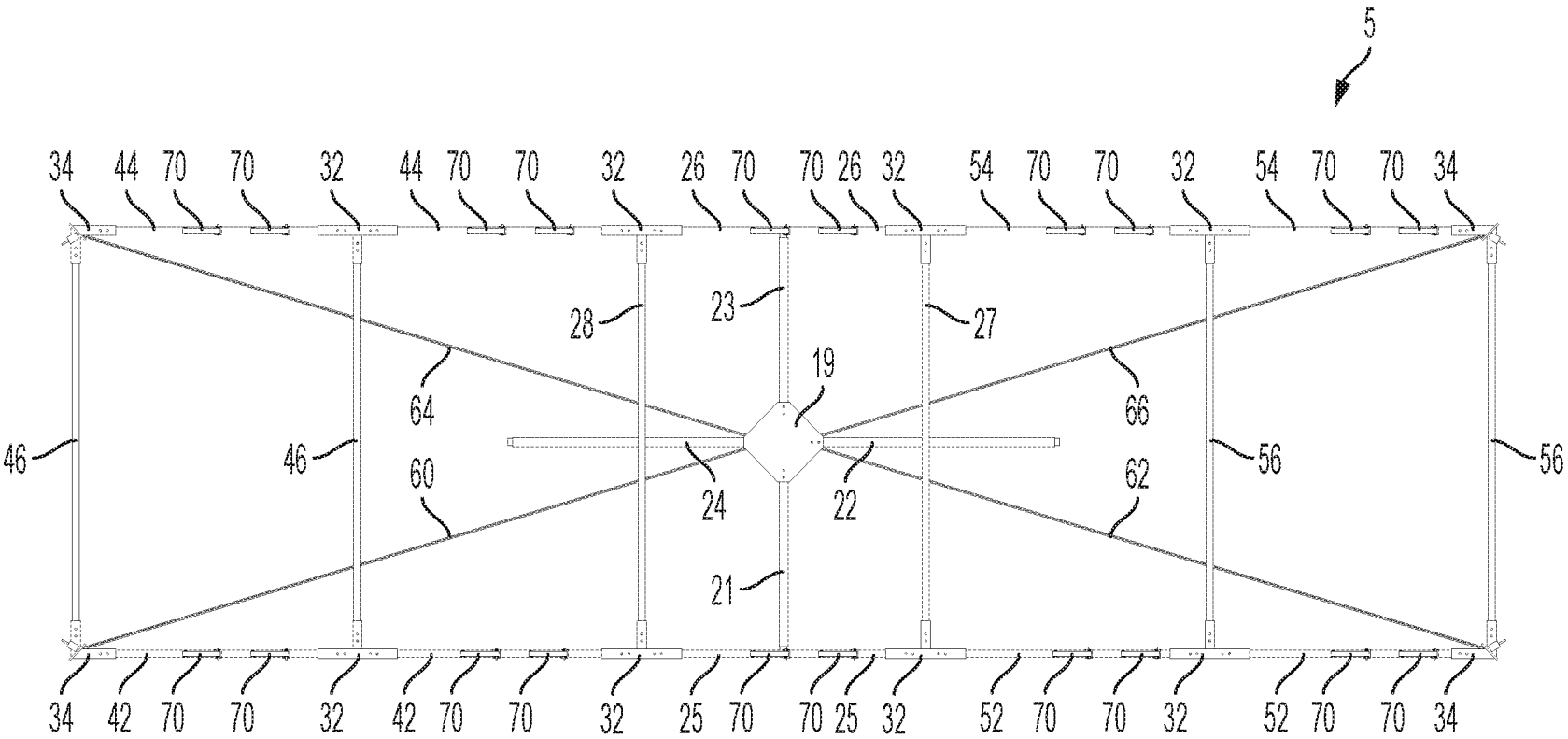
FIG. 7 is a bottom plan view of modular crane attachment device for purlins.
Figure 8:
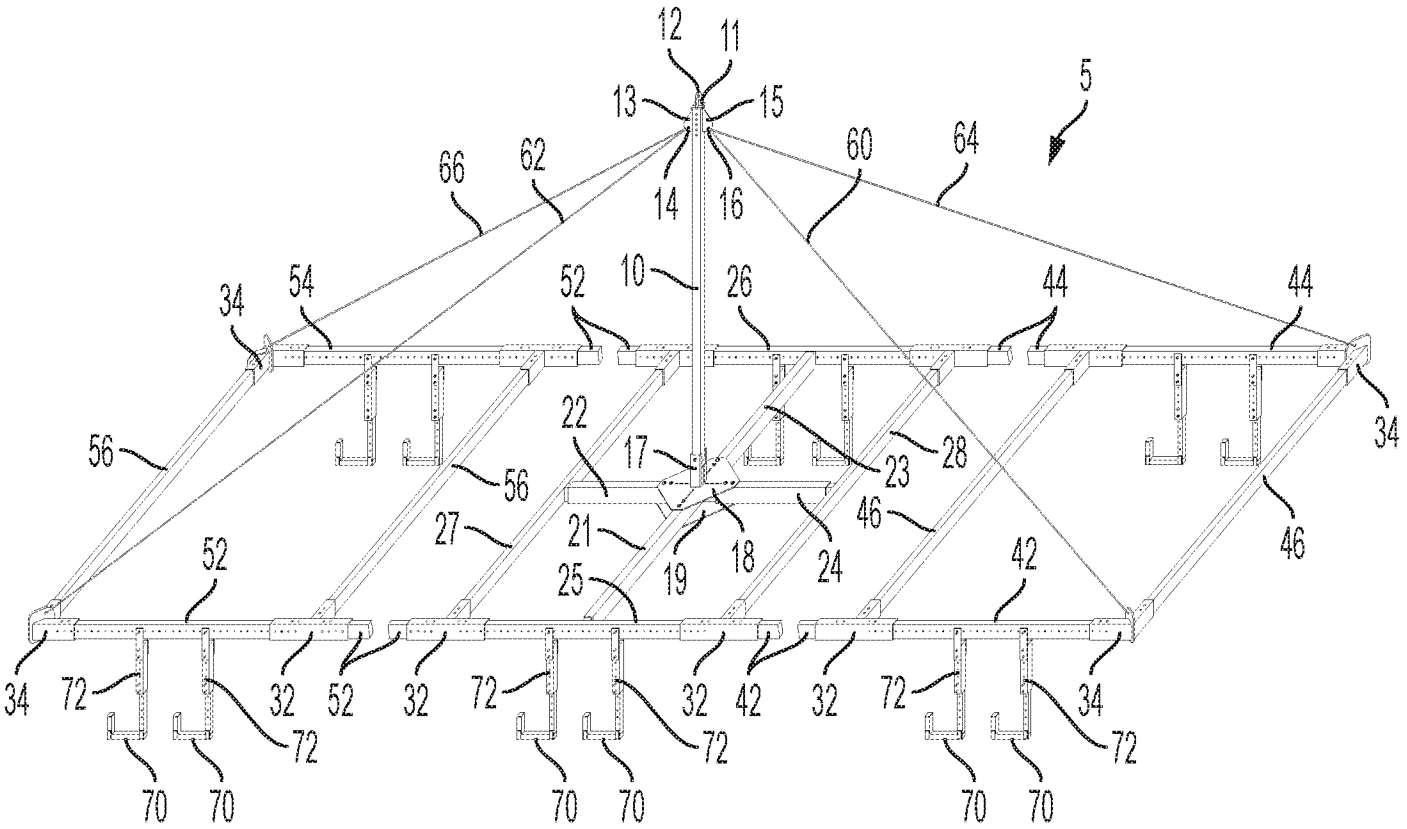
FIG. 8 is a perspective view of alternate modes of modular crane attachment device for purlins.
Figure 9:
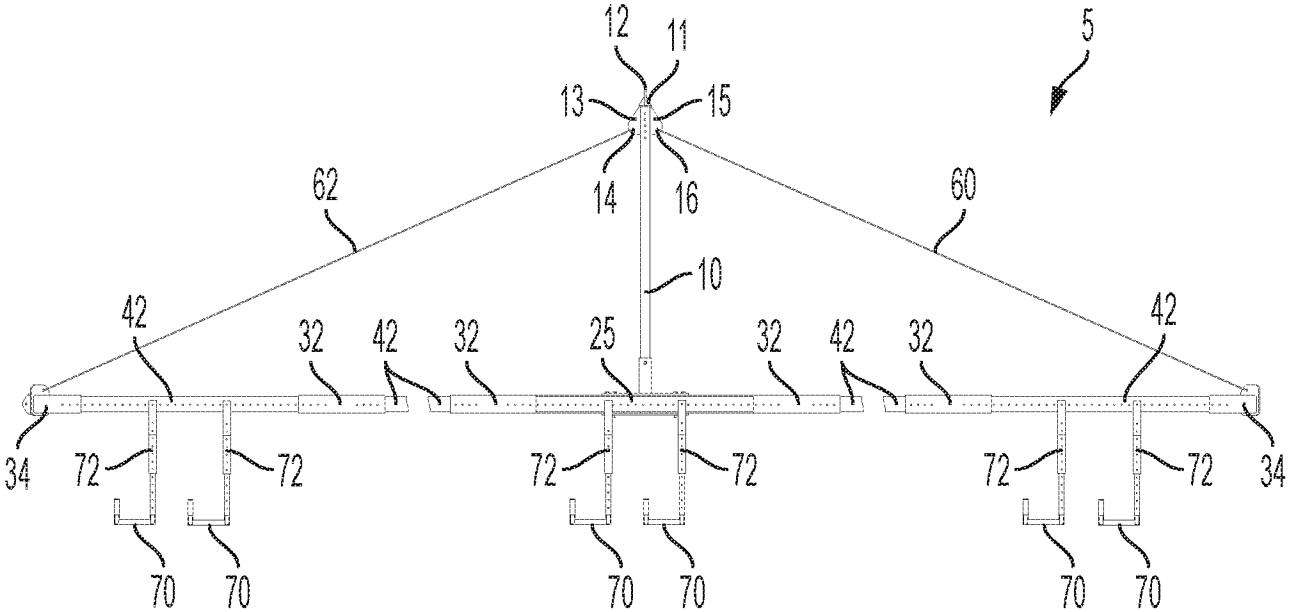
FIG. 9 is a front elevation view of alternate modes of modular crane attachment device for purlins.
Figure 10:
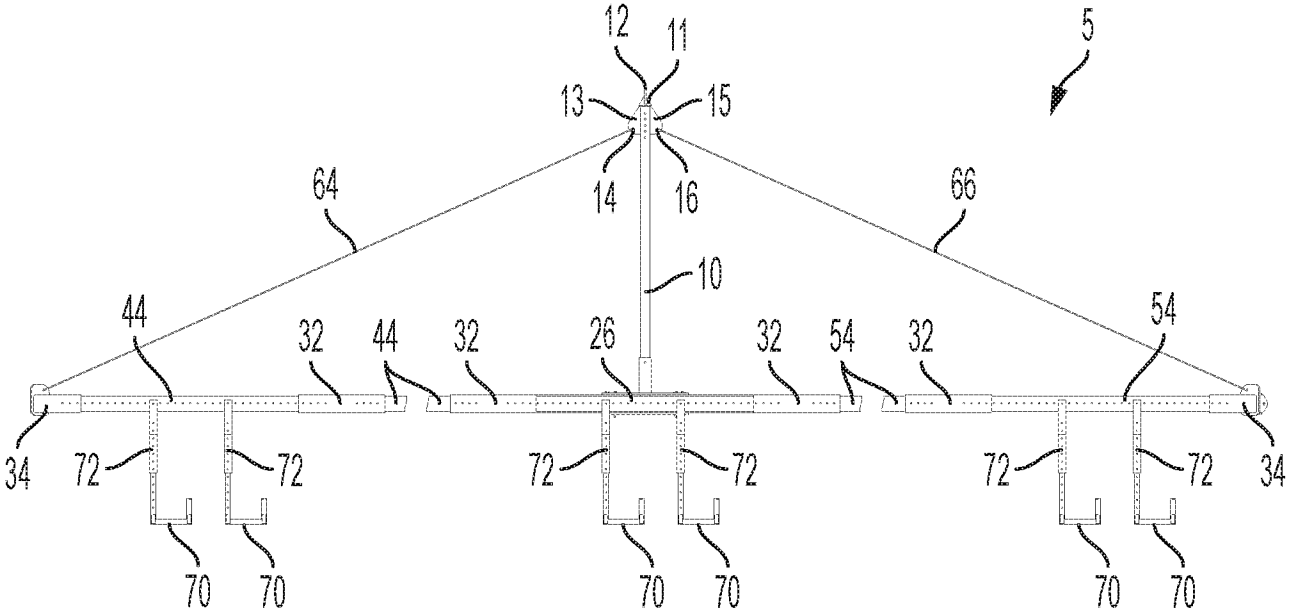
FIG. 10 is a rear elevation view of alternate modes of modular crane attachment device for purlins.
Figure 11:
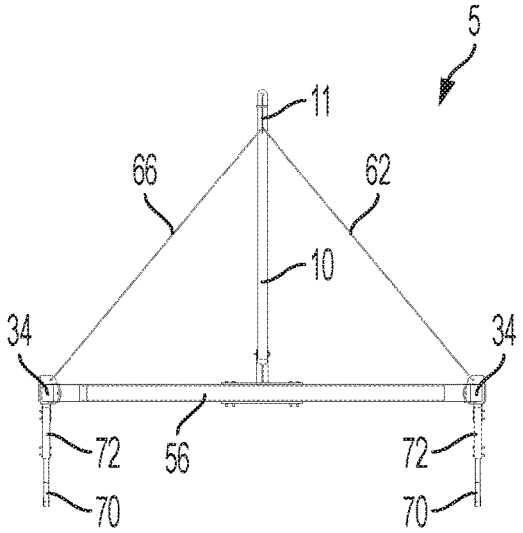
FIG. 11 is a left side elevation view of alternate modes of modular crane attachment device for purlins.
Figure 12:
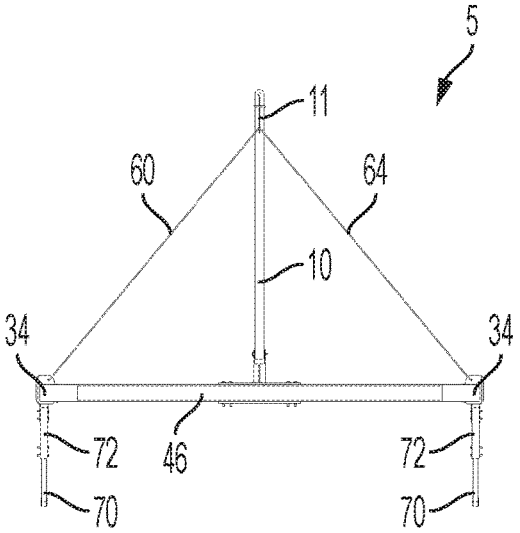
FIG. 12 is a right side elevation view of alternate modes of modular crane attachment device for purlins.
Figure 13:
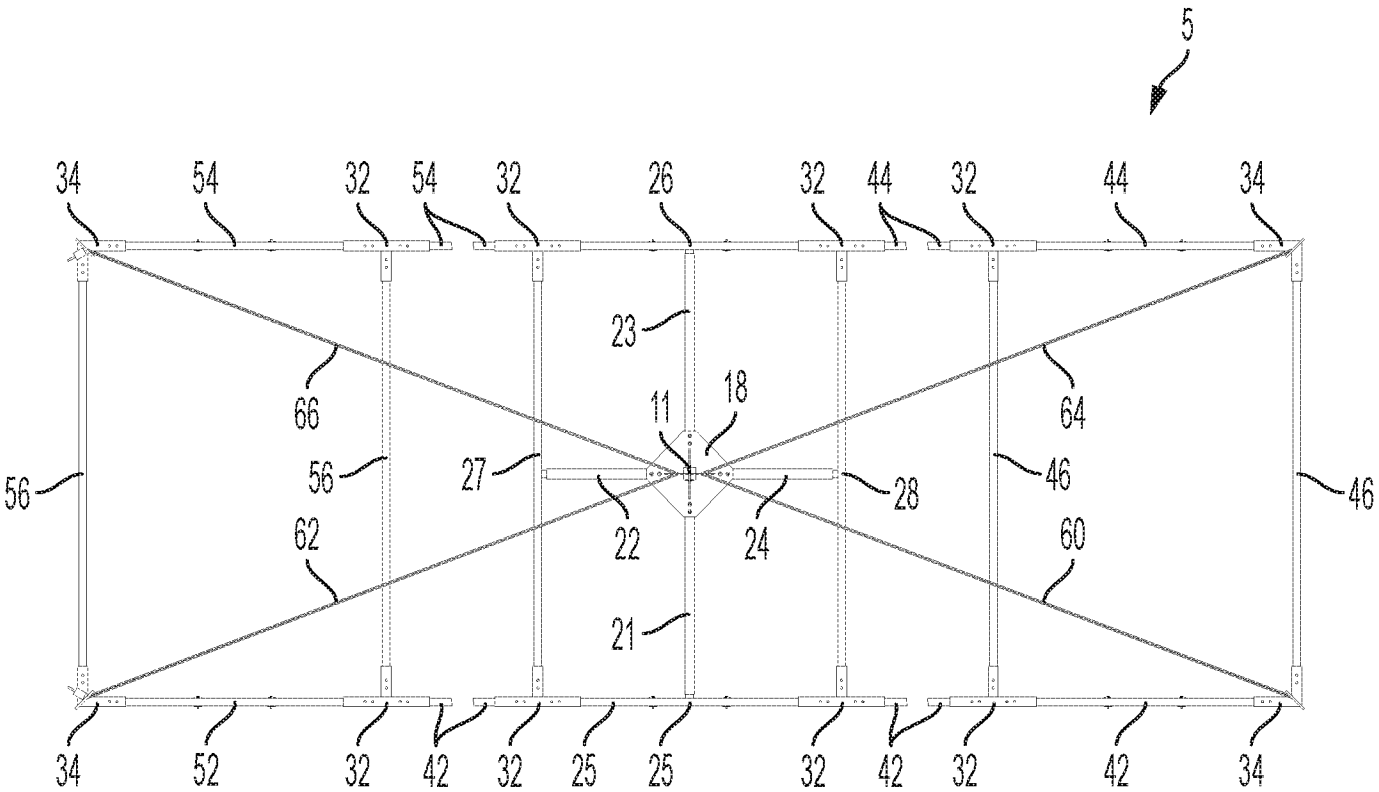
FIG. 13 is a top plan view of alternate modes of modular crane attachment device for purlins.
Figure 14:
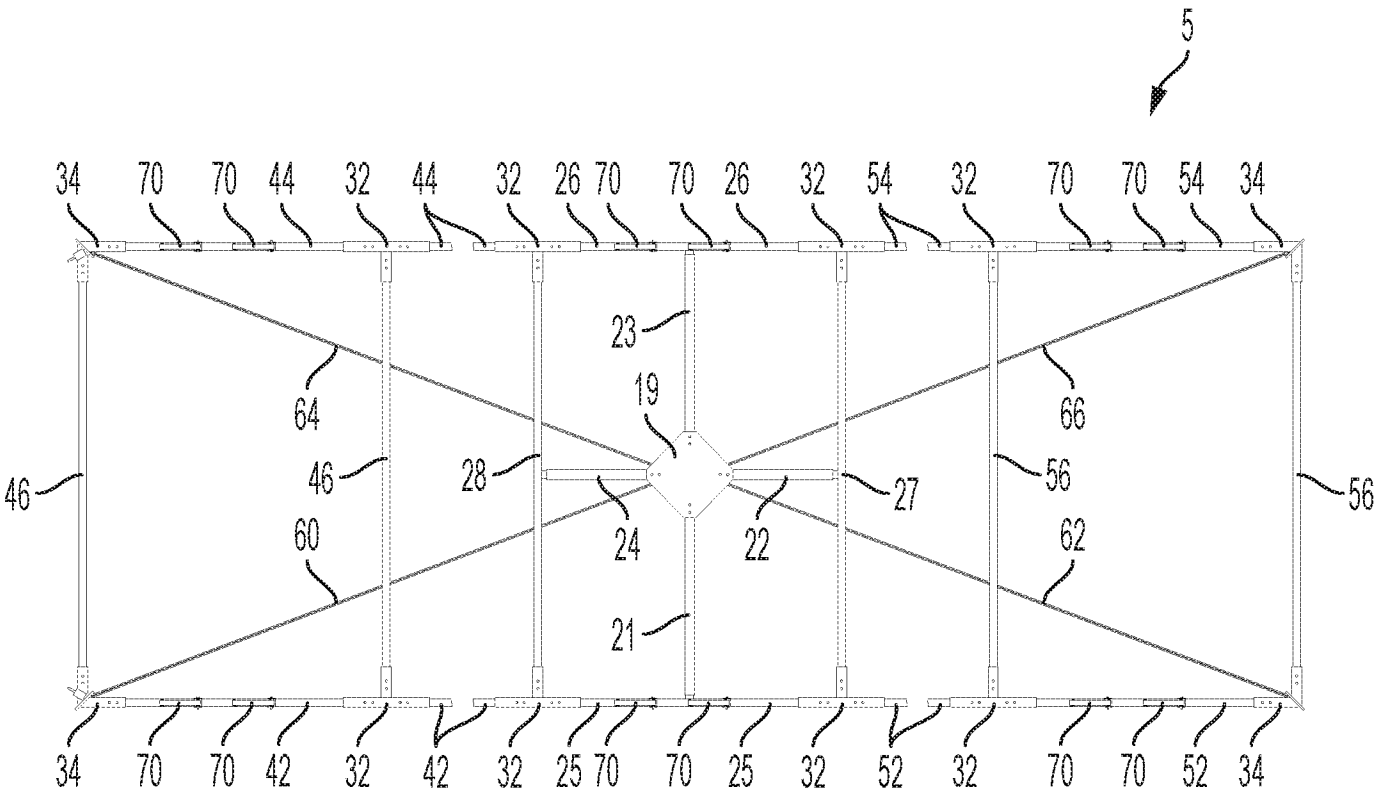
FIG. 14 is a bottom plan view of alternate modes of modular crane attachment device for purlins.
Figure 15:
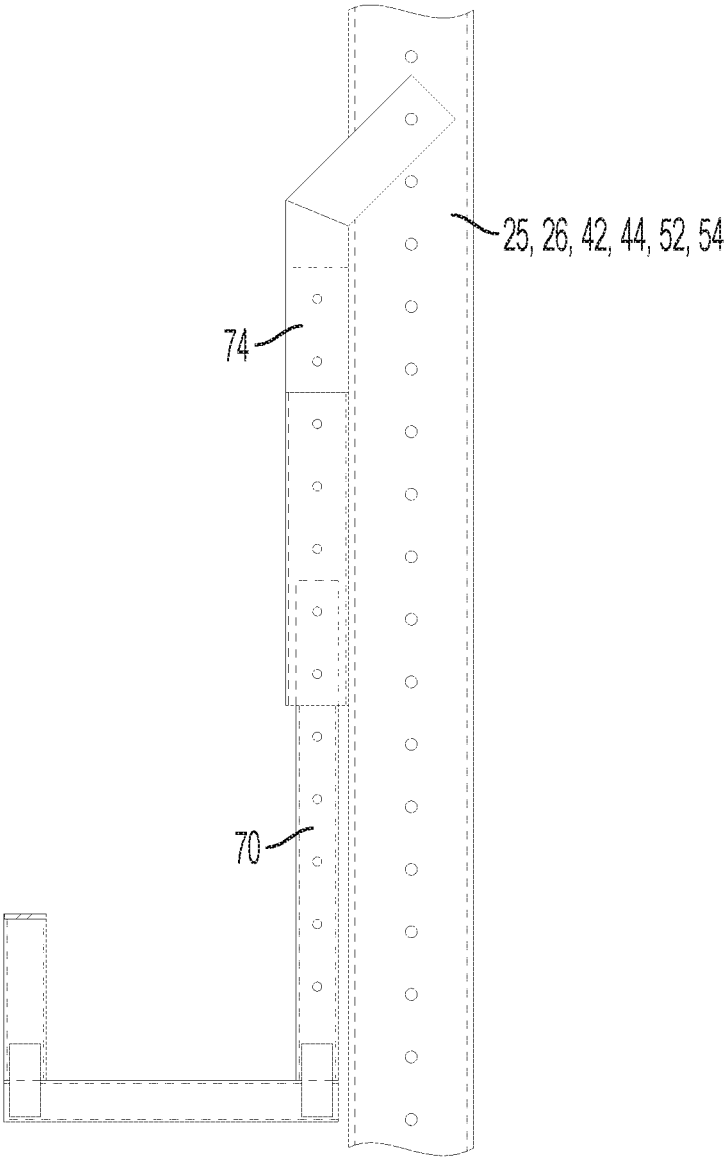
FIG. 15 is an enlarged front elevation view of J-hook and vertical J-hook receiver.
Figure 16:
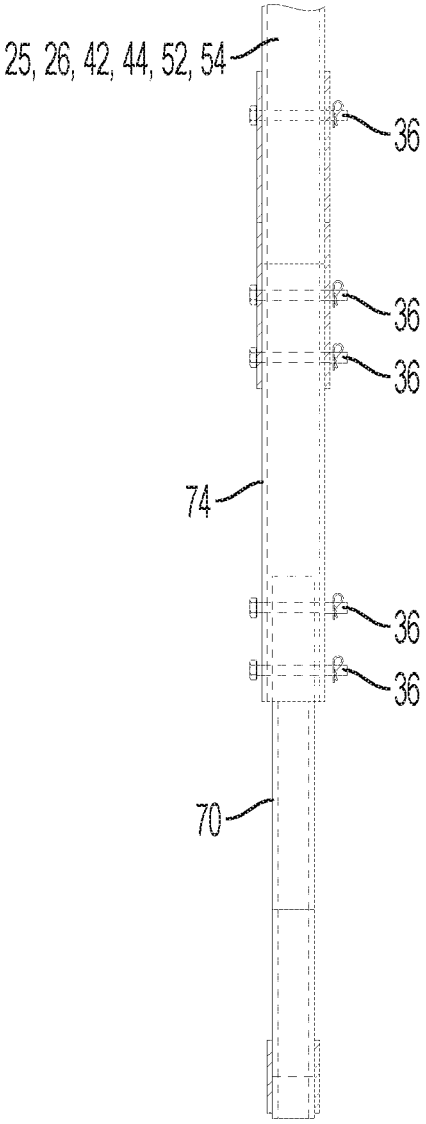
FIG. 16 is an enlarged right side elevation view of J-hook and vertical J-hook receiver.

Each vertical J-hook receiver 74 is a rigid elbow shaped vertical member with an upper end, a lower end, a front surface, a left surface, a rear surface, a right surface, a length, and a longitudinal axis. Vertical J-hook receiver 74 has a length of about 1-6 feet. Vertical J-hook receiver 74 has a plurality of holes spaced along its entire length. There is a plurality of holes in the front surface and the rear surface of vertical J-hook receiver 74. The upper end of vertical J-hook receiver 74 has two rigid parallel tabs or ears that break from the longitudinal axis to form a bend or elbow shape as depicted. The two rigid tabs or ears are askew with the lower end. In best mode, the tabs or ears form a 135-degree angle with the lower end. There is a hole in each tab or ear. The upper end of vertical J-hook receiver 74 is reversibly attachable to: center section front spreader bar 25, center section rear spreader bar 26, any right section front spreader bar 42, any right section rear spreader bar 44, any left section front spreader bar 52, or any left section rear spreader bar 54. Reversible attachment may be accomplished by any known means. In best mode, reversible attachment is accomplished by aligning the two holes in the upper end of vertical J-hook receiver 74 with two holes in: center section front spreader bar 25, center section rear spreader bar 26, any right section front spreader bar 42, any right section rear spreader bar 44, any left section front spreader bar 52, or any left section rear spreader bar 54, and then inserting a hinge pin or pin 36 through the four holes to create an attachment between these members, as depicted in FIGS. 15 and 16. A vertical J-hook receiver 74 may be attached to any position along the lengths of center section front spreader bar 25, center section rear spreader bar 26, any right section front spreader bar 42, any right section rear spreader bar 44, any left section front spreader bar 52, or any left section rear spreader bar 54 because there is a plurality of holes along these members as described above. In this way, modular crane attachment device for purlins 5 may be customized to fit any size building 100 with any required cross member to cross member distance. The lower end of vertical J-hook receiver 74 has an open-ended tubular shape. The lower end of vertical J-hook receiver 74 has an inner dimension or overall inner dimension that is slightly larger than the outer dimension of the long vertical member of J-hook 70. The lower end of vertical J-hook receiver 74 is reversibly attachable to the upper end of long vertical member of J-hook 70. Reversibly attachment may be accomplished by any known means. In best mode, reversibly attachment is accomplished by inserting the upper end of long vertical member of J-hook 70 into the open end of the lower end of vertical J-hook receiver 74 to align a hole on long vertical member of J-hook 70 with two holes in vertical J-hook receiver 74, one hole on its front surface and one hole on its rear surface, and then inserting a hinge pin or pin 36 through the holes to attach these members, as depicted in FIGS. 15 and 16. A J-hook 70 may be attached to vertical J-hook receiver 74 at multiple locations or different lengths because there is a plurality of holes along the length of the long vertical member of J-hook 70 where any one could be used to align with a plurality of holes along the length of Vertical J-hook receiver 74 for attachment thereto. Vertical J-hook receiver 74 may be made from any known rigid material such as: steel, metal, carbon fiber, composite, or any other known high strength material. In best mode, vertical J-hook receiver 74 is made of tubular steel.

In order to conduct a vertical lift, two or more corner splice fittings 34 must each further comprise a vertical lift tab. Each vertical lift tab is rigid planar member rigidly attached to the exterior surface of a corner splice fitting 34. Rigid attachment may be accomplished by any known means such as: weld, glue, epoxy, adhesive, bolts, screws, rivets, clips, or snaps. In best mode, rigid attachment is accomplished by welding. Each vertical lift tab has a vertical lift tab hole. Two vertical lift tabs are required to use modular crane attachment device for purlins 5 for a vertical lift. With vertical lifts, just two cables are used to attach modular crane attachment device for purlins 5 to crane hook 115. In contrast, with horizontal lifts, all four cables 60,62, 64,66 are used to attach modular crane attachment device for purlins 5 to crane hook 115. With vertical lifts, the lower end of left front cable 62 is reversibly attached to a vertical lift hole on a vertical lift tab on left front corner splice fitting 34 and the left rear cable 66 is reversibly attached to a vertical lift hole on a vertical lift tab on left rear corner splice fitting 34. Alternately, a vertical lift may be conducted with the lower end of right front cable 60 is reversibly attached to a vertical lift hole on a vertical lift tab on right front corner splice fitting 34 and the right rear cable 64 is reversibly attached to a vertical lift hole on a vertical lift tab on right rear corner splice fitting 34. A vertical lift is depicted in FIG. 20.

What is claimed is:

1. Modular crane attachment device for purlins comprises: a center section; a right section; a left section; a right front cable; a left front cable; a right rear cable; and a left rear cable, wherein, said center section comprises: a hoist post, a hoist post cap, a left lobe, a right lobe, a hoist post receiver, an upper hub plate, a lower hub plate, a front cross member, a left cross member, a rear cross member, a right cross member, a front spreader bar, a rear spreader bar, a left end member, a right end member, a left front T-splice fitting, a left rear T-splice fitting, a right front T-splice fitting, and a right rear T-splice fitting, wherein, said upper hub plate is a rigid planar member with an upper surface, a lower surface, a front end, a left end, a rear end, a right end, and a horizontal axis, said lower hub plate s is a rigid planar member with an upper surface, a lower surface, a front end, a left end, a rear end, a right end, and a horizontal axis, said hoist post is a rigid oblong vertical member with an upper end, a lower end, a left surface, a right surface, a length, and a longitudinal axis, said hoist post cap is rigid vertical planar member with a lift hole that is a circular opening or hole in said vertical member, said hoist post cap is rigidly attached to the upper end of said hoist post, said left lobe is a rigid vertical planar member with an upper half, a lower half, a right edge, a left edge, a front surface, a rear surface, and a longitudinal axis, said left lobe is rigidly attached to said left surface of said hoist post below said hoist post cap, said left lobe has a left lobe hole that is a circular opening or hole in said left lobe, said right lobe is a rigid vertical planar member with an upper half, a lower half, a right edge, a left edge, a front surface, a rear surface, and a longitudinal axis, said right lobe is rigidly attached to the right surface of hoist post below said hoist post cap, said right lobe has a right lobe hole that is a circular opening or hole in said right lobe, said hoist post receiver is a rigid vertical member with an upper end, a lower end, a front surface, a left surface, a rear surface, a right surface, and a longitudinal axis, said lower end of said hoist post receiver is rigidly attached to said upper surface of said upper hub plate so that said longitudinal axis of said hoist post receiver is perpendicular to said horizontal axis of said upper hub plate, said upper end of said hoist post receiver is reversibly pivotally attachable to said lower end of said hoist post, said upper surface of said upper hub plate is rigidly attached to said lower end of said hoist post receiver, said front cross member is a rigid oblong horizontal member with a front end, a rear end, an upper surface, a left surface, a lower surface, a right surface, a length, and a longitudinal axis, said left cross member is a rigid oblong horizontal member with a left end, a right end, an upper surface, a rear surface, a lower surface, a front surface, a length, and a longitudinal axis, said rear cross member is a rigid oblong horizontal member with a front end, a rear end, an upper surface, a left surface, a lower surface, a right surface, a length, and a longitudinal axis, said right cross member is a rigid oblong horizontal member with a left end, a right end, an upper surface, a front surface, a lower surface, a rear surface, a length, and a longitudinal axis, said upper surface of said front cross member is reversibly attached to said lower surface of said upper hub plate, said lower surface of said front cross member is reversibly attached to said upper surface of said lower hub plate, said upper surface of said left cross member is reversibly attached to said lower surface of said upper hub plate, said lower surface of said left cross member is reversibly attached to said upper surface of said lower hub plate, said upper surface of said rear cross member is reversibly attached to said lower surface of said upper hub plate, said lower surface of said rear cross member is reversibly attached to said upper surface of said lower hub plate, said upper surface of said right cross member is reversibly attached to said lower surface of said upper hub plate, said lower surface of said right cross member is reversibly attached to said upper surface of said lower hub plate, said longitudinal axis of said front cross member is coincident with that of said rear cross member, said longitudinal axis of said left cross member is coincident with that of said right cross member, said longitudinal axes of said front cross member and said rear cross member are perpendicular to said longitudinal axes of said left cross member and said right cross member, said center section front spreader bar is a rigid oblong horizontal member with a left end, a right end, an upper surface, a front surface, a lower surface, a rear surface, a length, a mid-point, and a longitudinal axis, said center section rear spreader bar is a rigid oblong horizontal member with a left end, a right end, an upper surface, a front surface, a lower surface, a rear surface, a length, a mid-point, and a longitudinal axis, said center section left end member is a rigid oblong horizontal member with a front end, a rear end, an upper surface, a left surface, a lower surface, a right surface, a length, a mid-point, and a longitudinal axis, said center section right end member is a rigid oblong horizontal member with a front end, a rear end, an upper surface, a left surface, a lower surface, a right surface, a length, a mid-point, and a longitudinal axis, said left front T-splice fitting is a female by female by female T-shaped rigid socket fitting or pipe fitting with a base socket, a left socket, and a right socket, said left rear T-splice fitting is a female by female by female T-shaped rigid socket fitting or pipe fitting with a base socket, a left socket, and a right socket, said right front T-splice fitting is a female by female by female T-shaped rigid socket fitting or pipe fitting with a base socket, a left socket, and a right socket, said right rear T-splice fitting is a female by female by female T-shaped rigid socket fitting or pipe fitting with a base socket, a left socket, and a right socket, said left end of said center section front spreader bar is reversibly attachable to said left socket of said left front T-splice fitting, said right end of said center section front spreader bar is reversibly attachable to said right socket of said right front T-splice fitting, said front end of said front cross member is reversibly attachable to said rear surface of said center section front spreader bar at said midpoint said center section front spreader bar, said left end of said center section rear spreader bar is reversibly attachable to said right socket of said left rear T-splice fitting, said right end of said center section rear spreader bar is reversibly attachable to said left socket of said right rear said T-splice fitting, said rear end of said rear cross member is reversibly attachable to said front surface of said center section rear spreader bar at said midpoint of said center section rear spreader bar, said front end of said center section left end member is reversibly attachable to said base socket of said left front T-splice fitting, said rear end of said center section left end member is reversibly attachable to said base socket of said left rear T-splice fitting, said left end of said left cross member is reversibly attachable to said right surface of said center section left end member at said midpoint of said center section left end member, center section right end member is reversibly attachable to said base socket of said right front T-splice fitting, said rear end of said center section right end member is reversibly attachable to said base socket of said right rear T-splice fitting, said right end of said right cross member is reversibly attachable to said left surface of said center section right end member at said midpoint of said center section right end member, said right section comprises: a right section front spreader bar, a right section rear spreader bar, a right section end member, a front corner splice fitting, and a rear corner splice fitting, said right section front spreader bar is a rigid oblong horizontal member with a left end, a right end, an upper surface, a front surface, a lower surface, a rear surface, a length, a mid-point, and a longitudinal axis, said right section rear spreader bar is a rigid oblong horizontal member with a left end, a right end, an upper surface, a front surface, a lower surface, rear surface, a length, a mid-point, and a longitudinal axis, said right section end member is a rigid oblong horizontal member with a front end, a rear end, an upper surface, a left surface, a lower surface, a right surface, a length, a mid-point, and a longitudinal axis, said front corner splice fitting is a female by female elbow or ninety-degree socket fitting or pipe fitting with a corner plate, a first socket, and a second socket wherein said corner plate is a rigid vertical planar member with a small hole, said rear corner splice fitting is a female by female elbow or ninety-degree socket fitting or pipe fitting with a corner plate, a first socket, and a second socket, wherein said corner plate is a rigid vertical planar member with a small hole, said left end of said right section front spreader bar is reversibly attachable to said left socket of said right front T-splice fitting on said center section, said right end of said right section front spreader bar is reversibly attachable to said first socket of said front corner splice fitting on said right section, said left end of said right section rear spreader bar is reversibly attachable to said right socket of said right rear T-splice fitting on said center section, said right end of said right section rear spreader bar is reversibly attachable to said first socket of the said rear corner splice fitting on said right section, said front end of said right section end member is reversibly attachable to said second socket of said front corner splice fitting on said right section, said rear end of said right section end member is reversibly attachable to said second socket of said rear corner splice fitting on said right section, said left section comprises: a left section front spreader bar, a left section rear spreader bar, a left section end member, a front corner splice fitting, and a rear corner splice fitting, said left section front spreader bar is a rigid oblong horizontal member with a left end, a right end, an upper surface, a front surface, a lower surface, a rear surface, a length, a mid-point, and a longitudinal axis, said left section rear spreader bar is a rigid oblong horizontal member with a left end, a right end, an upper surface, a front surface, a lower surface, a rear surface, a length, a mid-point, and a longitudinal axis, said left section end member is a rigid oblong horizontal member with a front end, a rear end, an upper surface, a left surface, a lower surface, a right surface, a length, a mid-point, and a longitudinal axis, said front corner splice fitting is a female by female elbow or ninety-degree socket fitting or pipe fitting with a corner plate, a first socket, and a second socket wherein said corner plate is a rigid vertical planar member with a small hole, said rear corner splice fitting is a female by female elbow or ninety-degree socket fitting or pipe fitting with a corner plate, a first socket, and a second socket, wherein said corner plate is a rigid vertical planar member with a small hole, said right end of said left section front spreader bar is reversibly attachable to said right socket of said left front T-splice fitting on said center section, said left end of said left section front spreader bar is reversibly attachable to said first socket of said front corner splice fitting on said left section, said right end of said left section rear spreader bar is reversibly attachable to said left socket of said left rear T-splice fitting on said center section, said left end of said left section rear spreader bar is reversibly attachable to said first socket of said rear corner splice fitting on said left section, said front end of said left section end member is reversibly attachable to said second socket of said front corner splice fitting on said left section, said rear end of said left section end member is reversibly attachable to said second socket of said rear corner splice fitting on said left section, said right front cable, said left front cable, said right rear cable, and said left rear cable are each a length of cable or thick rope of wire or nonmetallic fiber with an upper end and a lower end, said lower end of said right front cable is reversibly attachable to said lift hole on said front corner splice fitting of said right section, said lower end of said right rear cable is reversibly attachable to said lift hole on said rear corner splice fitting of said right section, said lower end of said left front cable is reversibly attachable to said lift hole on said front corner splice fitting of said left section, said lower end of said left rear cable is reversibly attachable to said lift hole on said rear corner splice fitting of said left section, said upper end of said right front cable is reversibly attachable to said right lobe hole, said upper end of said right rear cable is reversibly attachable to said right lobe hole, said upper end of said left front cable is reversibly attachable to said left lobe hole, and said upper end of said left rear cable is reversibly attachable to said left lobe hole.

2. Modular crane attachment device for purlins as recited in claim 1 further comprising: a plurality of J-hooks and a plurality of horizontal J-hook receivers, wherein, each of said plurality of J-hooks is a rigid J-shaped member, hook member, or hook shaped member comprising: a long vertical member, a horizontal member, and a short vertical member, wherein, said long vertical member is a rigid oblong vertical member with an upper end, a lower end, an outer dimension, a length, and a longitudinal axis, wherein there is a plurality of holes along said length, said horizontal member is a rigid oblong horizontal member with a left end, a right end, a length, and a longitudinal axis, said short vertical member is a rigid oblong vertical member with an upper end, a lower end, a length, and a longitudinal axis, said lower end of said long vertical member is rigidly attached to said right end of said horizontal member, said left end of said horizontal member is rigidly attached to said lower end of said short vertical member, said longitudinal axes of said long and short vertical members are parallel and perpendicular to said longitudinal axis of said horizontal member, each of said plurality of horizontal J-hook receivers is a rigid oblong vertical member with an upper end, a lower end, a front surface, a left surface, a rear surface, a right surface, a length, and a longitudinal axis, wherein there is a plurality of holes along said length, along said front surface, and along said rear surface, said upper end of said J-hook horizontal receiver is reversibly pivotally attachable to: said center section front spreader bar, said center section rear spreader bar, said right section front spreader bar, said right section rear spreader bar, said left section front spreader bar, and said left section rear spreader bar, and said lower end of said J-hook horizontal receiver is reversibly attachable to said upper end of said long vertical member of said J-hook.

3. Modular crane attachment device for purlins as recited in claim 1 further comprising: a plurality of J-hooks and a plurality of vertical J-hook receivers, wherein, each of said plurality of J-hooks is a rigid J-shaped member, hook member, or hook shaped member comprising: a long vertical member, a horizontal member, and a short vertical member, wherein, said long vertical member is a rigid oblong vertical member with an upper end, a lower end, an outer dimension, a length, and a longitudinal axis, wherein there is a plurality of holes along said length, said horizontal member is a rigid oblong horizontal member with a left end, a right end, a length, and a longitudinal axis, said short vertical member is a rigid oblong vertical member with an upper end, a lower end, a length, and a longitudinal axis, said lower end of said long vertical member is rigidly attached to said right end of said horizontal member, said left end of said horizontal member is rigidly attached to said lower end of said short vertical member, said longitudinal axes of said long and short vertical members are parallel and perpendicular to said longitudinal axis of said horizontal member, each of said plurality of vertical J-hook receivers is a rigid oblong vertical member with an upper end, a lower end, a front surface, a left surface, a rear surface, a right surface, a length, and a longitudinal axis, wherein there is a plurality of holes along said length, along said front surface, and along said rear surface, said upper end of said J-hook vertical receiver is reversibly pivotally attachable to: said center section front spreader bar, said center section rear spreader bar, said right section front spreader bar, said right section rear spreader bar, said left section front spreader bar, and said left section rear spreader bar, and said lower end of said J-hook vertical receiver is reversibly attachable to said upper end of said long vertical member of said J-hook.

4. Modular crane attachment device for purlins as recited in claim 1 further comprising: one or more additional right sections and one or more additional left sections, wherein, each said one or more additional right sections comprises: an additional right section front spreader bar, an additional right section rear spreader bar, an additional right section end member, a front T-splice fitting, and a rear T-splice fitting, said left end of said additional right section front spreader bar is reversibly attachable to said left socket of said right front T-splice fitting on said center section, said right end of said additional right section front spreader bar is reversibly attachable to said right socket of said front T-splice fitting on said additional right section, said left end of said additional right section rear spreader bar is reversibly attachable to said right socket of said right rear T-splice fitting on said center section, said right end of said additional right section rear spreader bar is reversibly attachable to said left socket of said rear T-splice fitting on said additional right section, said front end of said additional right section end member is reversibly attachable to said base socket of said front T-splice fitting on said additional right section, said rear end of said additional right section end member is reversibly attachable to said base socket of said rear T-splice fitting on said additional right section, said left end of said right section front spreader bar on said right section is reversibly attachable to said left socket on said front T-splice fitting on said additional right section, said left end of said right section rear spreader bar on said right section is reversibly attachable to said right socket on said rear T-splice fitting on said additional right section, each said one or more additional left sections comprises: an additional left section front spreader bar, an additional left section rear spreader bar, an additional left section end member, a front T-splice fitting, and a rear T-splice fitting, said right end of said additional left section front spreader bar is reversibly attachable to said right socket of said left front T-splice fitting on said center section, said left end of said additional left section front spreader bar is reversibly attachable to said left socket of said front T-splice fitting on said additional left section, said right end of said additional left section rear spreader bar is reversibly attachable to said left socket of said left rear T-splice fitting on said center section, said left end of said additional left section rear spreader bar is reversibly attachable to said right socket of said rear T-splice fitting on said additional left section, said front end of said additional left section end member is reversibly attachable to said base socket of said front T-splice fitting on said additional left section, said rear end of said additional left section end member is reversibly attachable to said base socket of said rear T-splice fitting on said additional left section, said right end of said left section front spreader bar on said left section is reversibly attachable to said right socket on said front T-splice fitting on said additional left section, and said right end of said left section rear spreader bar on said left section is reversibly attachable to said left socket on said rear T-splice fitting on said additional left section.

5. Modular crane attachment device for purlins as recited in claim 4 further comprising: a plurality of J-hooks and a plurality of horizontal J-hook receivers, wherein, each of said plurality of J-hooks is a rigid J-shaped member, hook member, or hook shaped member comprising: a long vertical member, a horizontal member, and a short vertical member, wherein, said long vertical member is a rigid oblong vertical member with an upper end, a lower end, an outer dimension, a length, and a longitudinal axis, wherein there is a plurality of holes along said length, said horizontal member is a rigid oblong horizontal member with a left end, a right end, a length, and a longitudinal axis, said short vertical member is a rigid oblong vertical member with an upper end, a lower end, a length, and a longitudinal axis, said lower end of said long vertical member is rigidly attached to said right end of said horizontal member, said left end of said horizontal member is rigidly attached to said lower end of said short vertical member, said longitudinal axes of said long and short vertical members are parallel and perpendicular to said longitudinal axis of said horizontal member, each of said plurality of horizontal J-hook receivers is a rigid oblong vertical member with an upper end, a lower end, a front surface, a left surface, a rear surface, a right surface, a length, and a longitudinal axis, wherein there is a plurality of holes along said length, along said front surface, and along said rear surface, said upper end of said J-hook horizontal receiver is reversibly pivotally attachable to: said center section front spreader bar, said center section rear spreader bar, said right section front spreader bar, said right section rear spreader bar, said left section front spreader bar, and said left section rear spreader bar, and said lower end of said J-hook horizontal receiver is reversibly attachable to said upper end of said long vertical member of said J-hook.

6. Modular crane attachment device for purlins as recited in claim 4 further comprising: a plurality of J-hooks and a plurality of vertical J-hook receivers, wherein, each of said plurality of J-hooks is a rigid J-shaped member, hook member, or hook shaped member comprising: a long vertical member, a horizontal member, and a short vertical member, wherein, said long vertical member is a rigid oblong vertical member with an upper end, a lower end, an outer dimension, a length, and a longitudinal axis, wherein there is a plurality of holes along said length, said horizontal member is a rigid oblong horizontal member with a left end, a right end, a length, and a longitudinal axis, said short vertical member is a rigid oblong vertical member with an upper end, a lower end, a length, and a longitudinal axis, said lower end of said long vertical member is rigidly attached to said right end of said horizontal member, said left end of said horizontal member is rigidly attached to said lower end of said short vertical member, said longitudinal axes of said long and short vertical members are parallel and perpendicular to said longitudinal axis of said horizontal member, each of said plurality of vertical J-hook receivers is a rigid oblong vertical member with an upper end, a lower end, a front surface, a left surface, a rear surface, a right surface, a length, and a longitudinal axis, wherein there is a plurality of holes along said length, along said front surface, and along said rear surface, said upper end of said J-hook vertical receiver is reversibly pivotally attachable to: said center section front spreader bar, said center section rear spreader bar, said right section front spreader bar, said right section rear spreader bar, said left section front spreader bar, and said left section rear spreader bar, and said lower end of said J-hook vertical receiver is reversibly attachable to said upper end of said long vertical member of said J-hook.

* * * * *